US006346202B1

(12) United States Patent
Molnar

(10) Patent No.: US 6,346,202 B1
(45) Date of Patent: Feb. 12, 2002

(54) FINISHING WITH PARTIAL ORGANIC BOUNDARY LAYER

(75) Inventor: Charles J. Molnar, Wilmington, DE (US)

(73) Assignee: Beaver Creek Concepts INC, Wilmington, DE (US)

( * ) Notice: Subject to any disclaimer, the term of this patent is extended or adjusted under 35 U.S.C. 154(b) by 0 days.

(21) Appl. No.: 09/533,473

(22) Filed: Mar. 23, 2000

Related U.S. Application Data

(63) Continuation-in-part of application No. 09/435,180, filed on Nov. 5, 1999, now abandoned, and a continuation-in-part of application No. 09/434,724, filed on Nov. 5, 1999, now abandoned.

(60) Provisional application No. 60/126,157, filed on Mar. 25, 1999, and provisional application No. 60/128,281, filed on Apr. 8, 1999.

(51) Int. Cl.[7] ..... C03C 15/00; C03C 25/68; H01L 21/304

(52) U.S. Cl. ..... 216/88; 216/52; 216/89; 252/79.1; 438/692; 451/36; 451/37; 451/53

(58) Field of Search ..... 156/345; 216/52, 216/53, 88–92; 438/7, 690–693; 451/5, 36–37, 53–54, 283–290; 252/79.1; 106/3

(56) References Cited

U.S. PATENT DOCUMENTS

| | | | | |
|---|---|---|---|---|
| 5,069,002 | A | 12/1991 | Sandhu | 513/165 R |
| 5,107,445 | A | 4/1992 | Jensen | 36/525 |
| 5,137,544 | A | 8/1992 | Medillin | 51/308 |
| 5,154,512 | A | 10/1992 | Schietinger | 374/9 |
| 5,166,080 | A | 11/1992 | Schietinger | 437/7 |
| 5,196,353 | A | 3/1993 | Sandhu | 437/7 |
| 5,308,438 | A | 5/1994 | Cote | 156/636 |
| 5,314,843 | A | 5/1994 | Yu | 437/225 |
| 5,340,370 | A | 8/1994 | Cadien | 51/38 |
| 5,352,277 | A | 10/1994 | Sasaki | 106/6 |
| 5,413,941 | A | 5/1995 | Koos | 437/8 |
| 5,595,526 | A | 1/1997 | Yau | 451/8 |
| 5,597,442 | A | 1/1997 | Chen | 156/626.1 |
| 5,609,511 | A | 3/1997 | Moriyama | 451/5 |
| 5,609,517 | A | 3/1997 | Lofaro | 451/529 |
| 5,614,444 | A | 3/1997 | Farkas | 437/225 |
| 5,639,388 | A | 6/1997 | Kimura | 216/84 |
| 5,643,060 | A | 7/1997 | Sandhu | 451/285 |
| 5,647,952 | A | 7/1997 | Chen | 156/636.1 |
| 5,667,629 | A | 9/1997 | Pan | 438/13 |
| 5,685,766 | A | 11/1997 | Mattingly | 451/36 |

(List continued on next page.)

FOREIGN PATENT DOCUMENTS

| | | | |
|---|---|---|---|
| WO | WO 98/08919 | 3/1998 | |
| WO | WO 99/65427 | 12/1999 | C09G/1/02 |
| WO | WO 00/00561 | 1/2000 | C09G/1/02 |
| WO | WO 00/00576 | 1/2000 | C09K/3/14 |

OTHER PUBLICATIONS

Berman, Mike et al., "Review of in Situ and in Line Detection for CMP Applic.", Semiconductor Fabtech, 8$^{th}$ edition, pp. 267–274.

Bibby, Thomas, "Endpoint Detection for CMP", Journal of Electronic Materials, vol. 27, #10, 1998, pp. 1073–1081.

*Primary Examiner*—Gregory Mills
*Assistant Examiner*—A C Powell

(57) ABSTRACT

A method of using a finishing element having a fixed abrasive finishing surface including organic boundary lubricants for finishing semiconductor wafers is described. The organic lubricants form an organic lubricating boundary layer in the operative finishing interface in a preferred coefficient of friction range. The selected coefficient of friction helps improve finishing and reduces unwanted surface defects. Differential lubricating boundary layer methods are described to differentially finish semiconductor wafers. Planarization and localized finishing can be improved using differential lubricating boundary layer methods of finishing.

28 Claims, 10 Drawing Sheets

U.S. PATENT DOCUMENTS 5,695,384 A 12/1997 Beratan ..... 451/28
5,695,660 A 12/1997 Litvak ..... 216/85
5,722,879 A 3/1998 Cronin ..... 451/281
5,728,308 A 3/1998 Muroyama ..... 216/88
5,733,176 A 3/1998 Robinson ..... 451/41
5,733,819 A 3/1998 Kodama ..... 438/692
5,735,036 A 4/1998 Barr ..... 29/603.12
5,738,562 A 4/1998 Doan ..... 451/5
5,743,784 A 4/1998 Birang ..... 451/21
5,749,769 A 5/1998 Church ..... 451/5
5,759,917 A 6/1998 Grover et al. ..... 438/690
5,762,537 A 6/1998 Sandhu ..... 451/7
5,783,489 A 7/1998 Kaufman ..... 438/692
5,830,280 A 11/1998 Sato ..... 134/2
5,833,519 A 11/1998 Moore ..... 451/56
5,842,909 A 12/1998 Sandhu ..... 451/7
5,858,813 A 1/1999 Scherber ..... 438/693
5,860,847 A 1/1999 Sakurai et al. ..... 451/10
5,871,392 A * 2/1999 Meikle et al. ..... 451/56
5,876,266 A 3/1999 Miller ..... 451/56
5,876,470 A 3/1999 Ronay ..... 106/3
5,885,137 A 3/1999 Ploessl ..... 106/3
5,885,334 A 3/1999 Suzuki ..... 438/639
5,906,754 A 5/1999 Appel ..... 216/88
5,910,041 A 6/1999 Duescher ..... 451/28
5,916,855 A 6/1999 Avanzino ..... 51/307
5,919,082 A 7/1999 Walker ..... 451/41
5,934,978 A 8/1999 Burke ..... 451/36 A
5,945,347 A 8/1999 Wright ..... 438/692
5,954,975 A 9/1999 Cadien ..... 216/38
5,954,997 A * 9/1999 Kaufman et al. ..... 252/79.1
5,958,794 A 9/1999 Bruxuoort ..... 438/692
5,968,280 A 10/1999 Ronay ..... 134/2
5,972,793 A 10/1999 Tseng ..... 438/692
5,985,045 A 11/1999 Kobayashi ..... 148/240
5,993,298 A 11/1999 Duescher ..... 451/56
6,121,143 A 9/2000 Messner et al. ..... 438/692

* cited by examiner

Figre 5 Effective COF as a function of the fraction of the surface area free of organic boundary layer lubrication
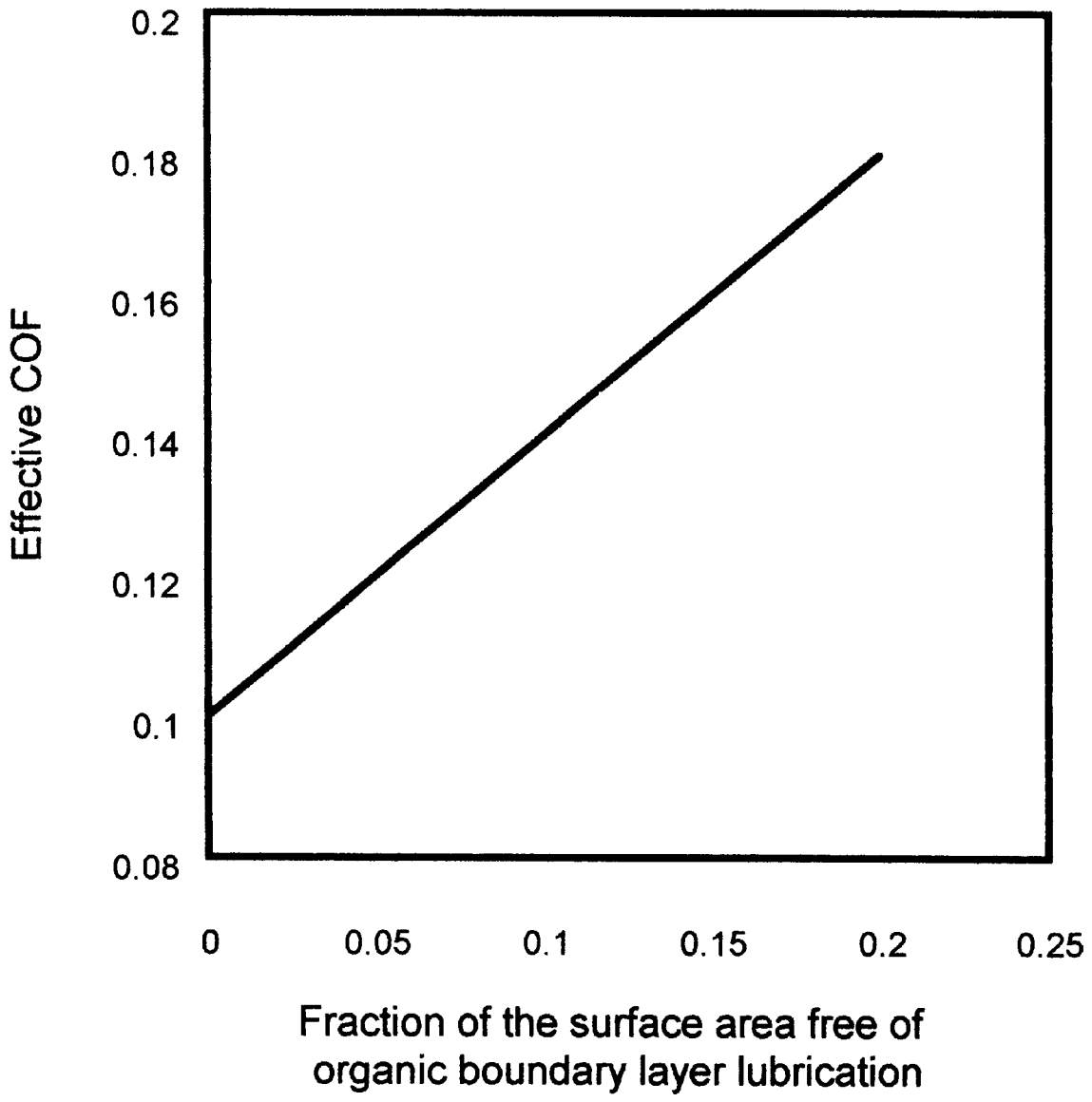

Figure 6 Normalized finishing rate as a function of the fraction of surface area free of organic boundary layer lubrication
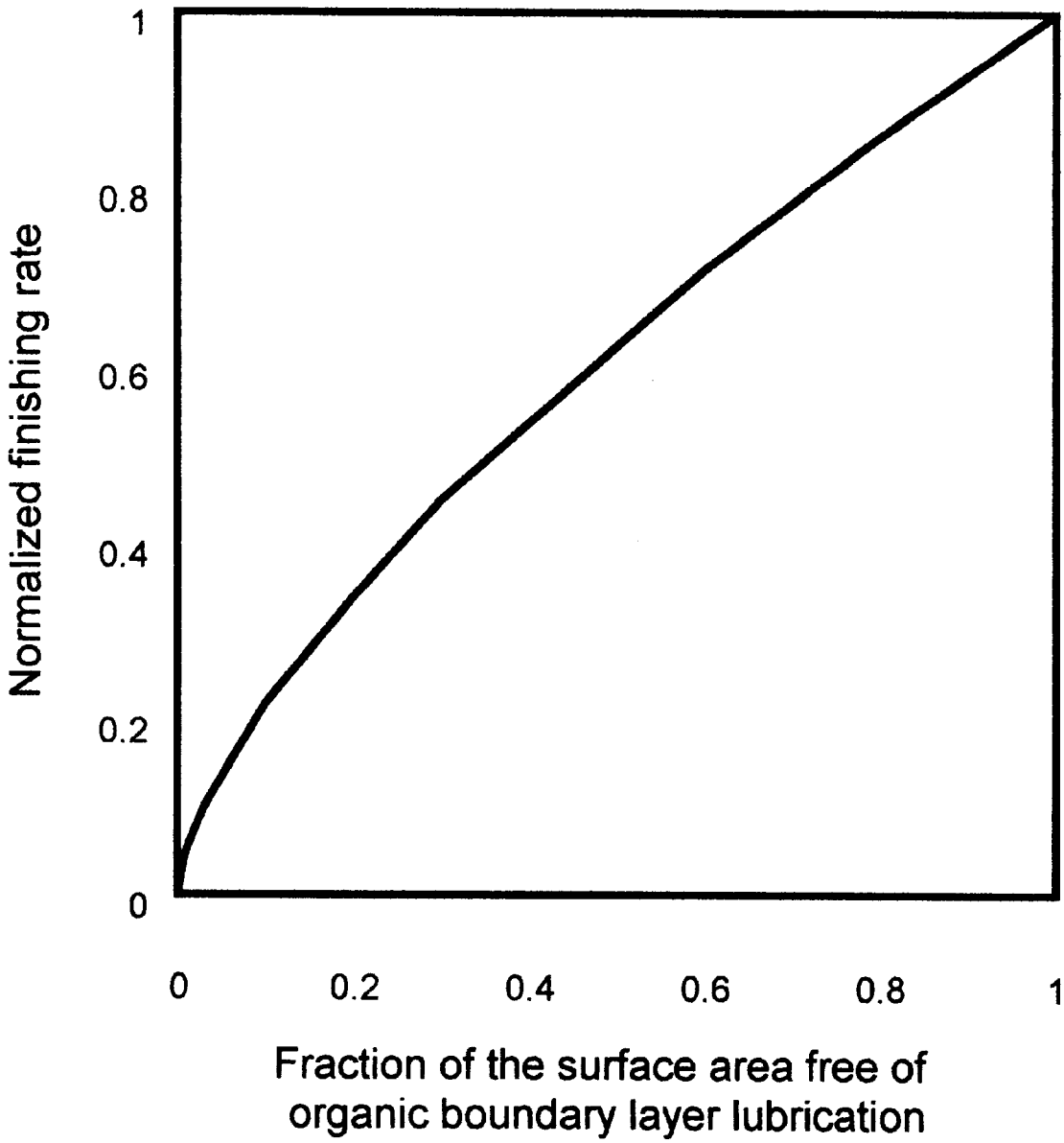

Figure 7 Relative abraded particle size on a non lubricated surface to the abraded particle size on an organic boundary layer lubricated surface vs fraction of the surface area free of organic boundary layer lubrication
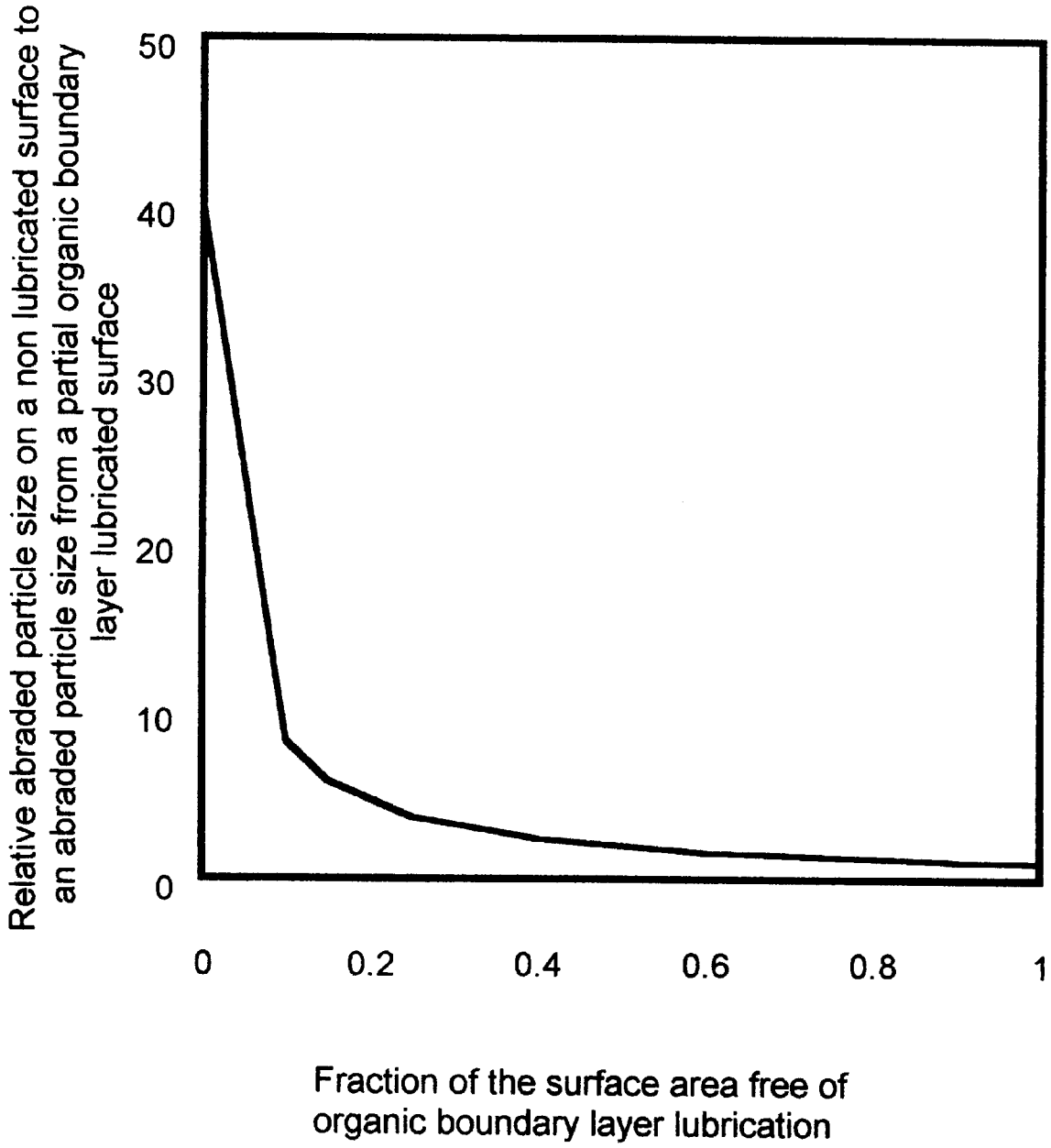

FINISHING WITH PARTIAL ORGANIC BOUNDARY LAYER

This application claims the benefit of Provisional Application serial No. 60/126,157 filed on Mar. 25, 1999 entitled "Finishing semiconductor wafers with partial organic boundary lubrication"; and Provisional application serial No. 60/128,281 filed on Apr. 8, 1999 entitled "Semiconductor wafer finishing with partial organic boundary layer lubricant". This application is a continuation in part of Application Ser. No. 09/435,180 now abandoned filed on Nov. 5, 1999 entitled "Finishing method for semiconductor wafers using a lubricating boundary layer" and Application Ser. No. 09/434,724 now abandoned filed on Nov. 5, 1999 entitled "Finishing element having finishing aids". All Applications which this application claims benefit to are included herein by reference in their entirety.

BACKGROUND ART

Chemical mechanical polishing (CMP) is generally known in the art. For example U.S. Pat. No. 5,177,908 issued to Tuttle in 1993 describes a finishing element for semiconductor wafers, having a face shaped to provide a constant, or nearly constant, surface contact rate to a workpiece such as a semiconductor wafer in order to effect improved planarity of the workpiece. U.S. Pat. No. 5,234,867 issued to Schultz et. al. in 1993 describes an apparatus for planarizing semiconductor wafers which in a preferred form includes a rotatable platen for polishing a surface of the semiconductor wafer and a motor for rotating the platen and a non-circular pad is mounted atop the platen to engage and polish the surface of the semiconductor wafer. Fixed abrasive finishing elements are known for polishing semiconductor layers. An example is WO 98/18159 PCT application by Minnesota Mining and Manufacturing.

An objective of polishing of semiconductor layers is to make the semiconductor layers as nearly perfect as possible. The finishing pad finishing surfaces can suffer from being overly harsh on a workpiece causing unwanted scratching or other unwanted surface damage thus reducing the perfection of the surface. Further, a finishing pad finishing surface can suffer from having a higher than necessary coefficient of friction when finishing a workpiece. This higher than necessary coefficient of friction can lead to other unwanted surface damage. Further, fixed abrasive finishing pads can have abrasive particles unexpectedly break away from their surface during finishing and these broken away abrasive particles can scratch or damage the workpiece surface. Still further, during finishing a particle can break away from the workpiece surface forming a workpiece abrasive particle which can scratch or damage the workpiece surface. These unwanted effects are particularly important and deleterious to yield when manufacturing electronic wafers which require extremely close tolerances in required planarity and feature sizes. If, however, large amounts of boundary lubricant are used, current confidential evaluations indicate that finishing rates can be slowed more than needed which raises the cost to finish a workpiece.

It is an advantage of this invention to reduce the harshness of finishing pads on the workpiece surface being finished. It is an advantage of this invention to reduce unwanted scratching or other unwanted surface damage on the workpiece surface during finishing. It is further an advantage of this invention to reduce the coefficient of friction during finishing a workpiece to help reduce unwanted surface damage. It is an advantage of this invention to reduce unwanted damage to the workpiece surface when during finishing with an abrasive particle from an abrasive finishing element unexpectedly breaks away from its surface. It is an advantage of the invention to reduce unwanted damage to the workpiece surface when an abrasive workpiece particle breaks away workpiece surface during finishing. It is further an advantage that if slurry particles agglomerate that unwanted surface damage can often be reduced. It is further an advantage of this invention to help improve yield for workpieces having extremely close tolerances such as semiconductor wafers. It is further an advantage of this invention to develop a method with improved optimization of finishing rates and boundary lubrication.

These and other advantages of the invention will become readily apparent to those of ordinary skill in the art after reading the following disclosure of the invention.

BRIEF DESCRIPTION OF DRAWING FIGURES

Figure 4:
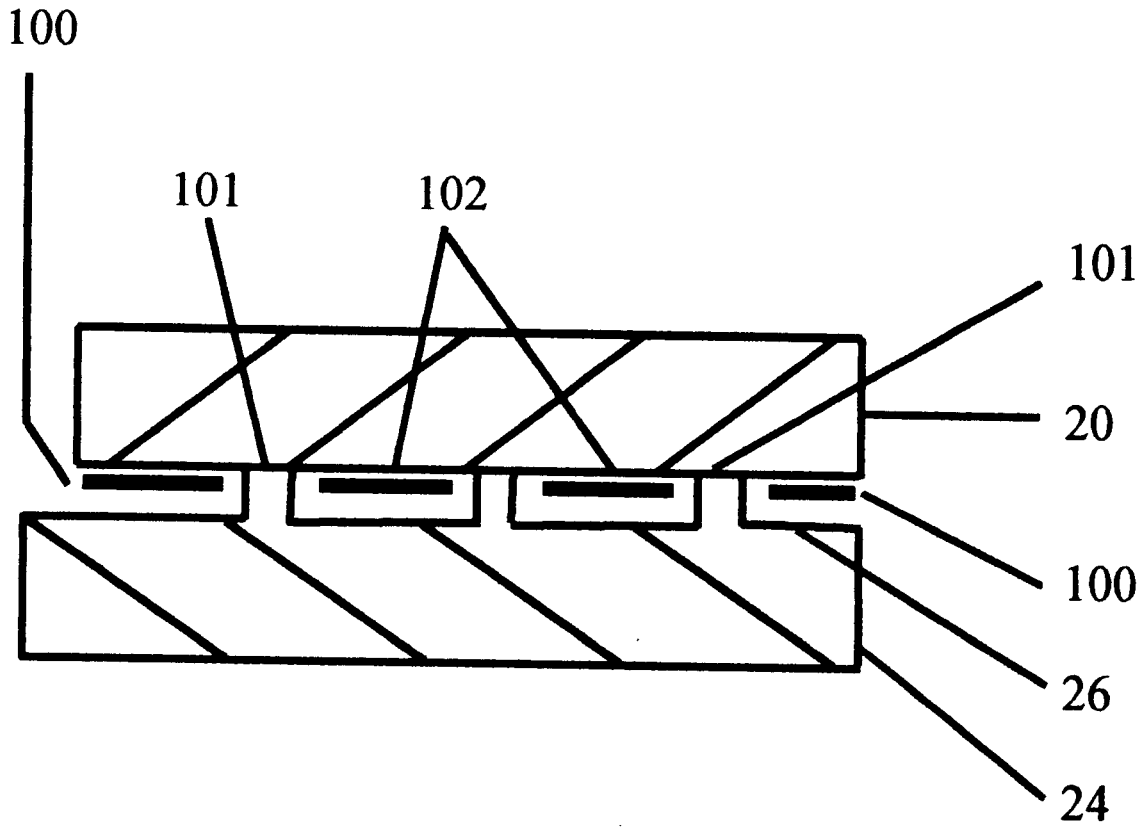
Figure 8A:
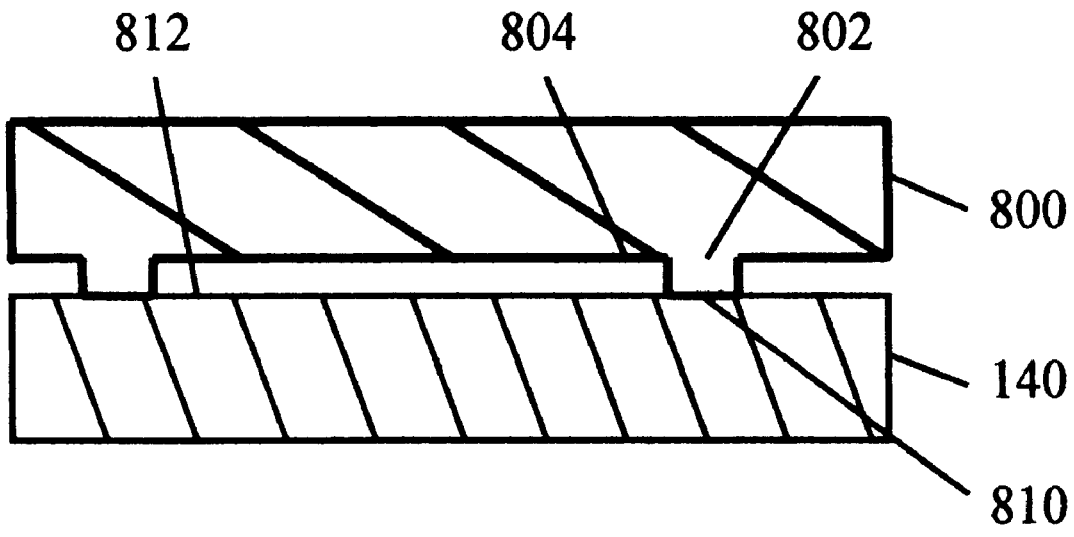
Figure 8B:
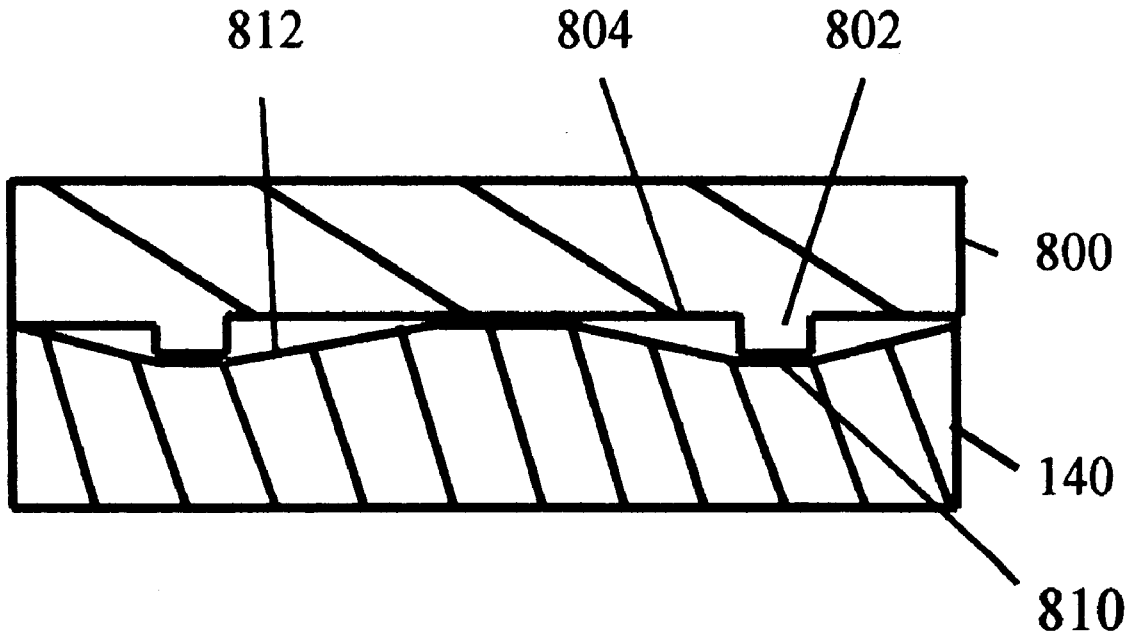

FIG. 4 is an artist's representation of a micro-region of the operative finishing interface showing one artist's view of the regions FIG. 5 is a plot of effective COF vs fraction of the surface area free of organic boundary layer lubrication FIG. 6 is a plot of the normalized finishing rate as a function of surface area free of organic boundary layer lubrication FIG. 7 is a plot of relative abraded particle size on a non lubricated surface to the abraded particle size on an organic boundary layer lubricated surface vs. fraction of the surface area free of organic boundary layer lubrication FIG. 8 is an artist's representation of finishing some unwanted raised regions and some regions below the unwanted raised regions with differential boundary lubrication.

Figure 9:
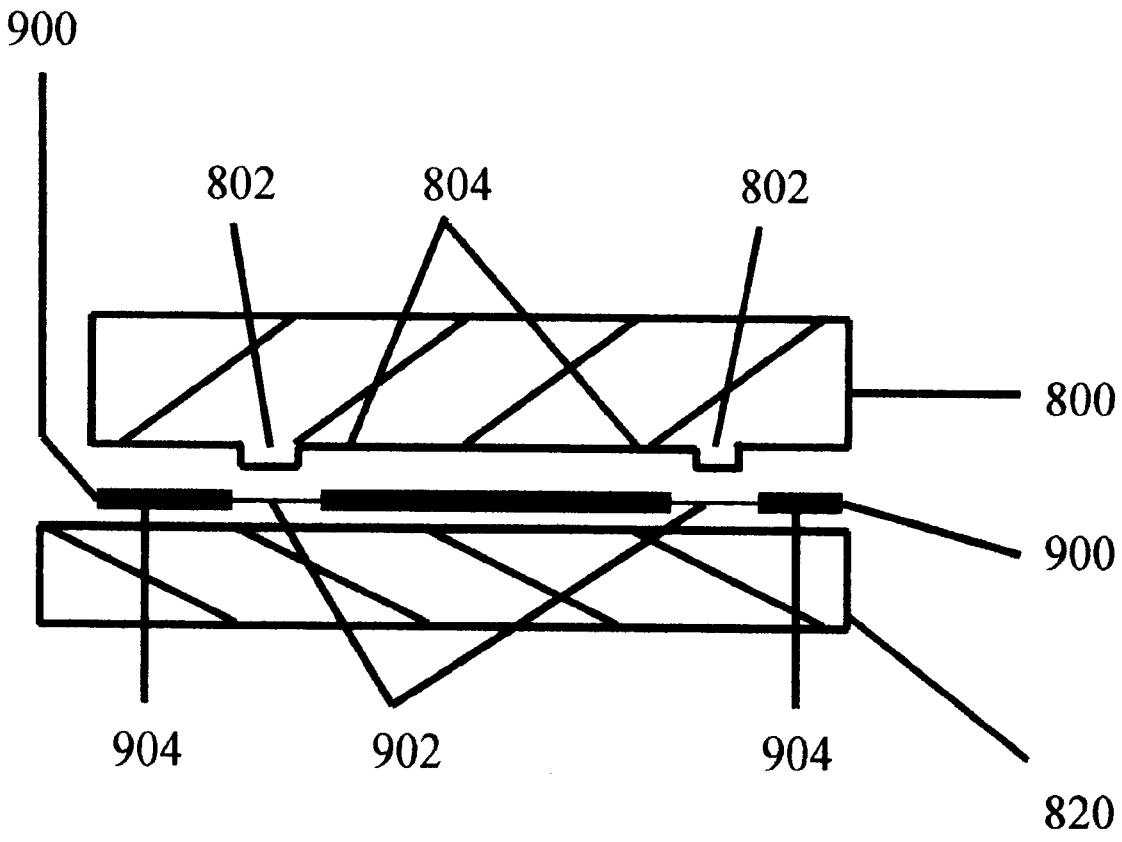
Figure 10:
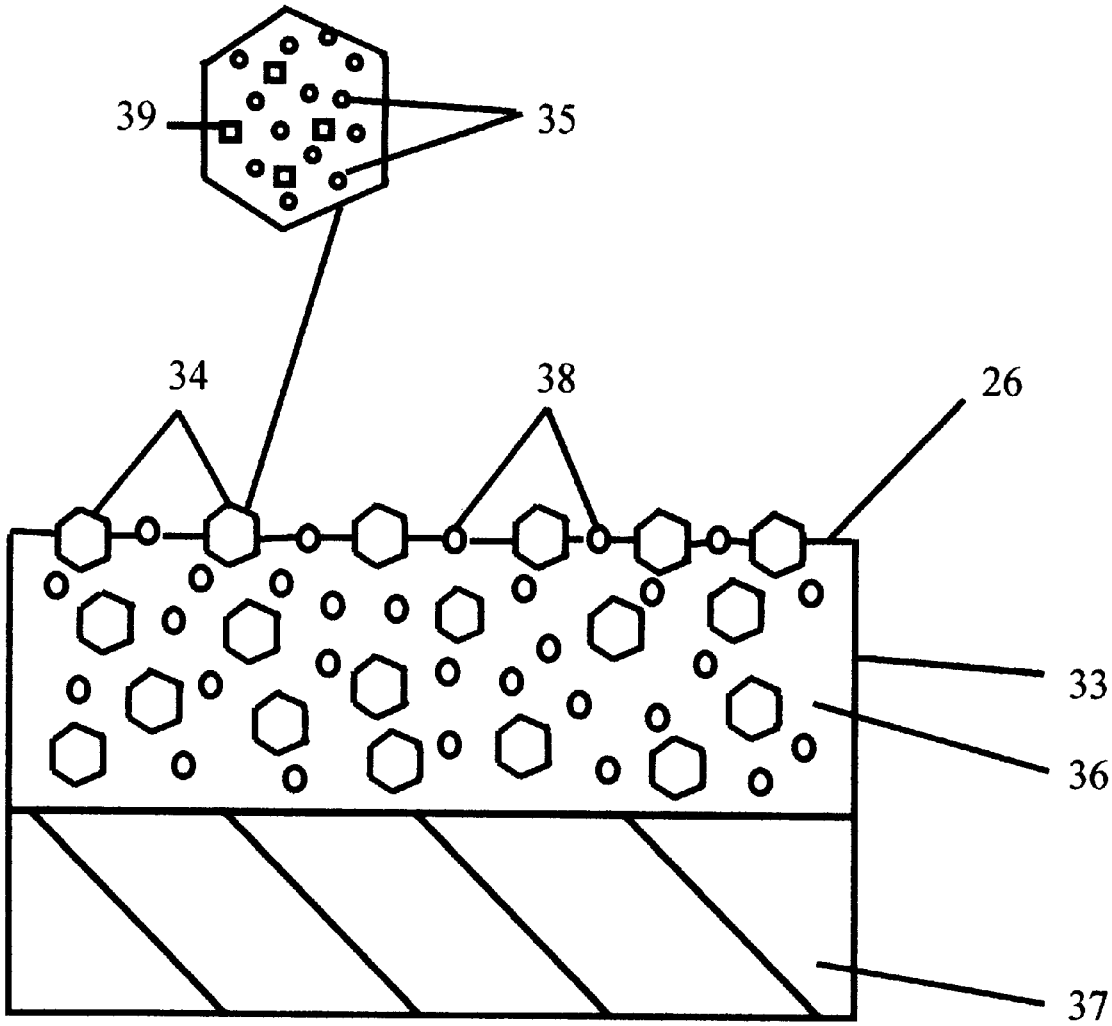

FIG. 9 is an artist's representation of an example of the effects on the boundary layer lubrication FIG. 10 is an artist's view of one embodiment of a finishing element

REFERENCE NUMERALS IN DRAWINGS

Reference Numeral 4 direction of rotation of the finishing element finishing surface Reference Numeral 6 direction of rotation of the workpiece being finished Reference Numeral 8 center of the rotation of the workpiece Reference Numeral 10 aqueous lubricating composition feed line for adding an aqueous lubricating composition Reference Numeral 12 a reservoir of aqueous lubricating composition Reference Numeral 14 alternate finishing composition feed line for adding other chemicals Reference Numeral 16 reservoir of alternate finishing composition Reference Numeral 17 rotating carrier for the workpiece Reference Numeral 18 operative contact element Reference Numeral 20 workpiece Reference Numeral 21 workpiece surface facing away from the workpiece surface being finished.
Reference Numeral 22 surface of the workpiece being finished
Reference Numeral 23 raised surface perturbation
Reference Numeral 24 finishing element
Reference Numeral 26 finishing element finishing surface
Reference Numeral 28 finishing element surface facing away from workpiece surface being finished
Reference Numeral 30 polishing composition
Reference Numeral 31 pressure applied to operative finishing interface
Reference Numeral 32 operative finishing motion
Reference Numeral 33 closeup of finishing element
Reference Numeral 34 synthetic resin particles
Reference Numeral 35 abrasive particles
Reference Numeral 36 continuous phase synthetic resin matrix
Reference Numeral 37 finishing element subsurface layer
Reference Numeral 38 optional finishing aids in continuous phase of polymer
Reference Numeral 39 optional finishing aids in discrete phase of polymer
Reference Numeral 40 platen
Reference Numeral 42 surface of the platen facing the finishing element
Reference Numeral 44 surface of the platen facing away from the finishing element
Reference Numeral 54 base support structure
Reference Numeral 56 surface of the base support structure facing the platen
Reference Numeral 60 carrier housing
Reference Numeral 62 pressure distributive element
Reference Numeral 100 organic boundary layer lubrication
Reference Numeral 101 regions of the workpiece which are effectively free of an organic boundary layer lubrication
Reference Numeral 102 regions of the workpiece lubricated with an organic boundary layer lubrication
Reference Numeral 140 small section of the finishing element
Reference Numeral 800 portion of a semiconductor wafer surface having two unwanted raised regions.
Reference Numeral 802 unwanted raised regions on the semiconductor surface being finished.
Reference Numeral 804 lower local regions on the semiconductor surface being finished proximate to the unwanted raised regions.
Reference Numeral 810 portion of finishing element finishing surface
Reference Numeral 812 finishing element surface local region displaced from but proximate to and lower than the unwanted raised local regions.
Reference Numeral 900 boundary layer lubrication.
Reference Numeral 902 regions of partial or no local boundary layer lubrication
Reference Numeral 904 regions of boundary layer lubrication

SUMMARY OF THE INVENTION

A preferred embodiment of this invention is directed to a method of finishing of a semiconductor wafer surface being finished comprising the steps of a) providing a finishing element finishing surface; step b) providing an organic boundary lubricant between the finishing element surface and the workpiece being finished; and step c) applying an operative finishing motion between the workpiece surface being finished and the finishing element wherein from 0.001 to 25 surface area fraction of the semiconductor wafer surface being finished is effectively free of organic boundary layer lubrication for at least a portion of the finishing cycle.

Other preferred embodiments are discussed herein.

DETAILED DESCRIPTION OF PREFERRED EMBODIMENTS OF THE INVENTION

The book *Chemical Mechanical Planarization of Microelectric Materials* by Steigerwald, J. M. et al. published by John Wiley & Sons, ISBN 0471138274 generally describes chemical mechanical finishing and is included herein by reference in its entirety for general background. In chemical mechanical finishing the workpiece is generally separated from the finishing element by a polishing slurry. The workpiece surface being finished is in parallel motion with finishing element finishing surface disposed towards the workpiece surface being finished. The abrasive particles such as found in a polishing slurry are interposed between these surfaces finish the workpiece. In sharp contrast to the prior art, no abrasive slurry is introduced between the workpiece surface being finished and the finishing element finishing surface in some preferred embodiments of this invention.

Discussion of some of the terms useful to aid in understanding this invention are now presented. Finishing is a term used herein for both planarizing and polishing. Planarizing is the process of making a surface which has raised surface perturbations or cupped lower areas into a planar surface and thus involves reducing or eliminating the raised surface perturbations and cupped lower areas. Planarizing changes the topography of the work piece from non planar to ideally perfectly planar. Polishing is the process of smoothing or polishing the surface of an object and tends to follow the topography of the workpiece surface being polished A finishing element is a term used herein to describe a pad or element for both polishing and planarizing. A finishing element finishing surface is a term used herein for a finishing element surface used for both polishing and planarizing. A finishing element planarizing surface is a term used herein for a finishing element surface used for planarizing. A finishing element polishing surface is a term used herein for a finishing element surface used for polishing. Workpiece surface being finished is a term used herein for a workpiece surface undergoing either or both polishing and planarizing. A workpiece surface being planarized is a workpiece surface undergoing planarizing. A workpiece surface being polished is a workpiece surface undergoing polishing. The finishing cycle time is the elapsed time in minutes that the workpiece is being finished. A portion of a finishing cycle time is about 5% to 95% of the total finishing cycle time in minutes and a more preferred portion of a finishing cycle time is 10% to 90% of the total finishing cycle time in minutes. The planarizing cycle time is the elapsed time in minutes that the workpiece is being planarized. The polishing cycle time is the elapsed time in minutes that the workpiece is being polished.

As used herein, an emulsion is a fluid containing a microscopically heterogeneous mixture of two (2) normally immiscible liquid phases, in which one liquid forms minute droplets suspended in the other liquid As used herein, a surfactant is a surface active substance, i.e., alters (usually reduces) the surface tension of water. Non limiting examples of surfactants include ionic, nonionic, and cationic. As used herein, a lubricant is an agent that reduces friction between moving surfaces. A hydrocarbon oil is a non limiting example of substance not soluble in water. As used herein, soluble means capable of mixing with a liquid (dissolving) to form a homogeneous mixture (solution).

As used herein, a dispersion is a fluid containing a microscopically heterogeneous mixture of solid phase material dispersed in a liquid and in which the solid phase material is in minute particles suspended in the liquid.

As used herein, a die is one unit on a semiconductor wafer generally separated by scribe lines. After the semiconductor wafer fabrication steps are completed, the die are separated into units, generally by sawing. The separated units are generally referred to as "chips". Each semiconductor wafer generally has many die which are generally rectangular. The terminology semiconductor wafer and die are generally known to those skilled in the arts. As used herein, within die uniformity refers to the uniformity within the die. As used herein, local planarity refers to die planarity unless specifically defined otherwise. Within wafer uniformity refers to the uniformity of finishing of the wafer. As used herein, wafer planarity refers to planarity across a wafer. Multiple die planarity is the planarity across a defined number of die. As used herein, global wafer planarity refers to planarity across the entire semiconductor wafer planarity. Planarity is important for the photolithography step generally common to semiconductor wafer processing, particularly where feature sizes are less than 0.25 microns. As used herein, a device is a discrete circuit such as a transistor, resistor, or capacitor. As used herein, pattern density is ratio of the raised (up) area in square millimeters to the to area in square millimeters of region on a specific region such as a die or semiconductor wafer. As used herein, pattern density is ratio of the raised (up) area in square millimeters to the total area in square millimeters of a region on a specific region such as a die or semiconductor wafer. As used herein, line pattern density is the ratio of the line width to the pitch. As used herein, pitch is line width plus the oxide space. As an illustrative example, pitch is the copper line width plus the oxide spacing. Oxide pattern density, as used herein, is the volume fraction of the oxide within an infinitesimally thin surface of the die.

Figure 1:
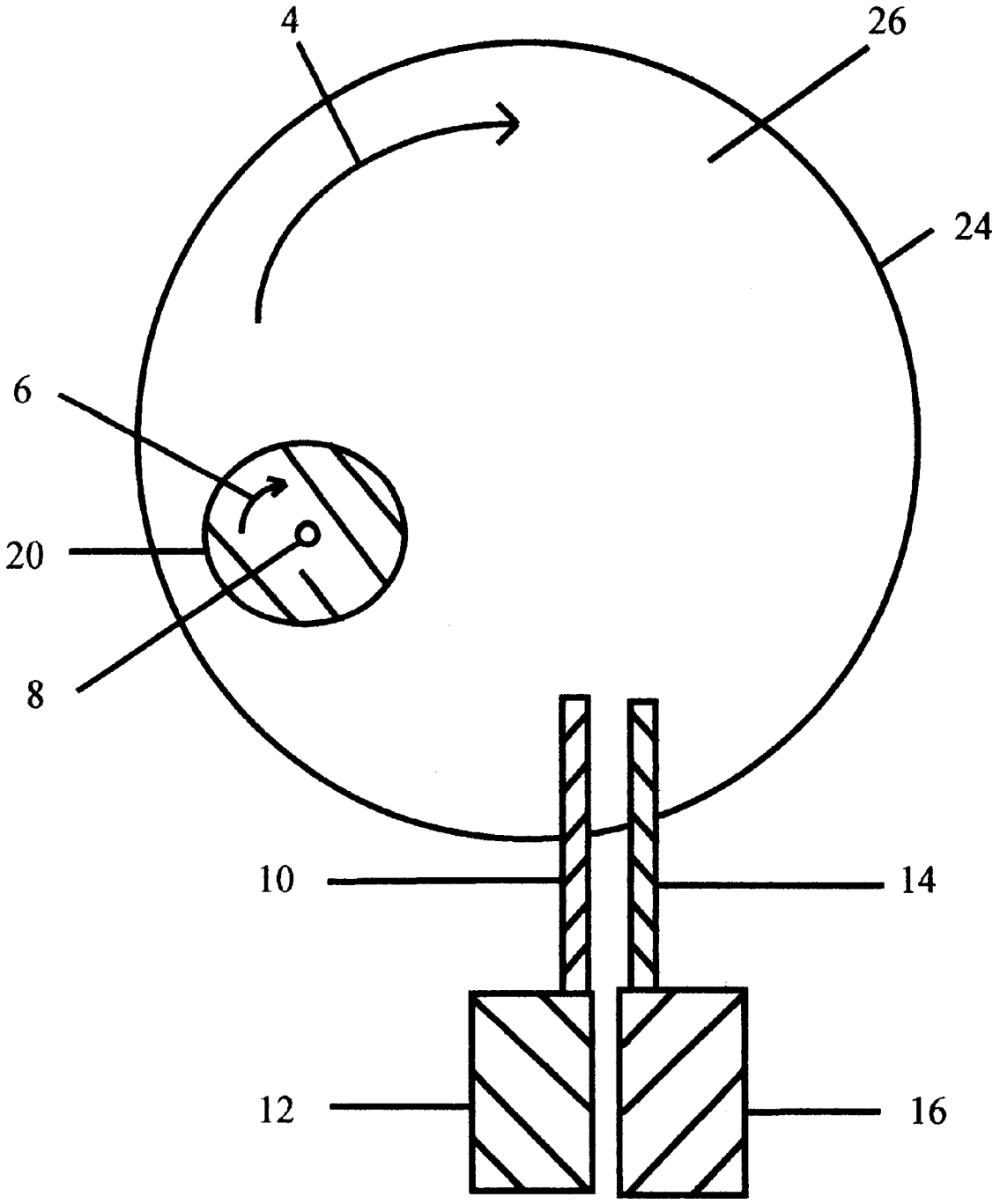
FIG. 1 is an artist's drawing of the interrelationships of the different materials when finishing according to this invention.
Figure 2:
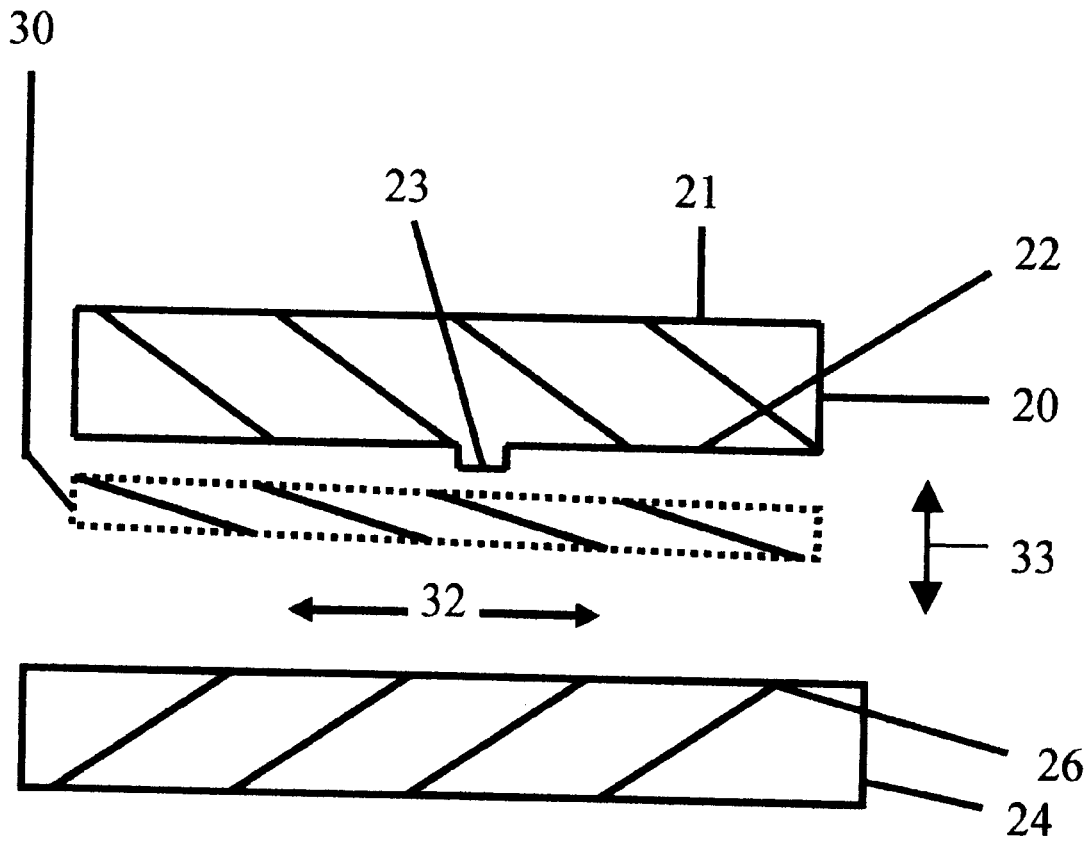
FIG. 2 is an artist's drawing of a particularly preferred embodiment of this invention including the interrelationships of the different objects when finishing according to this invention.
Figure 3:
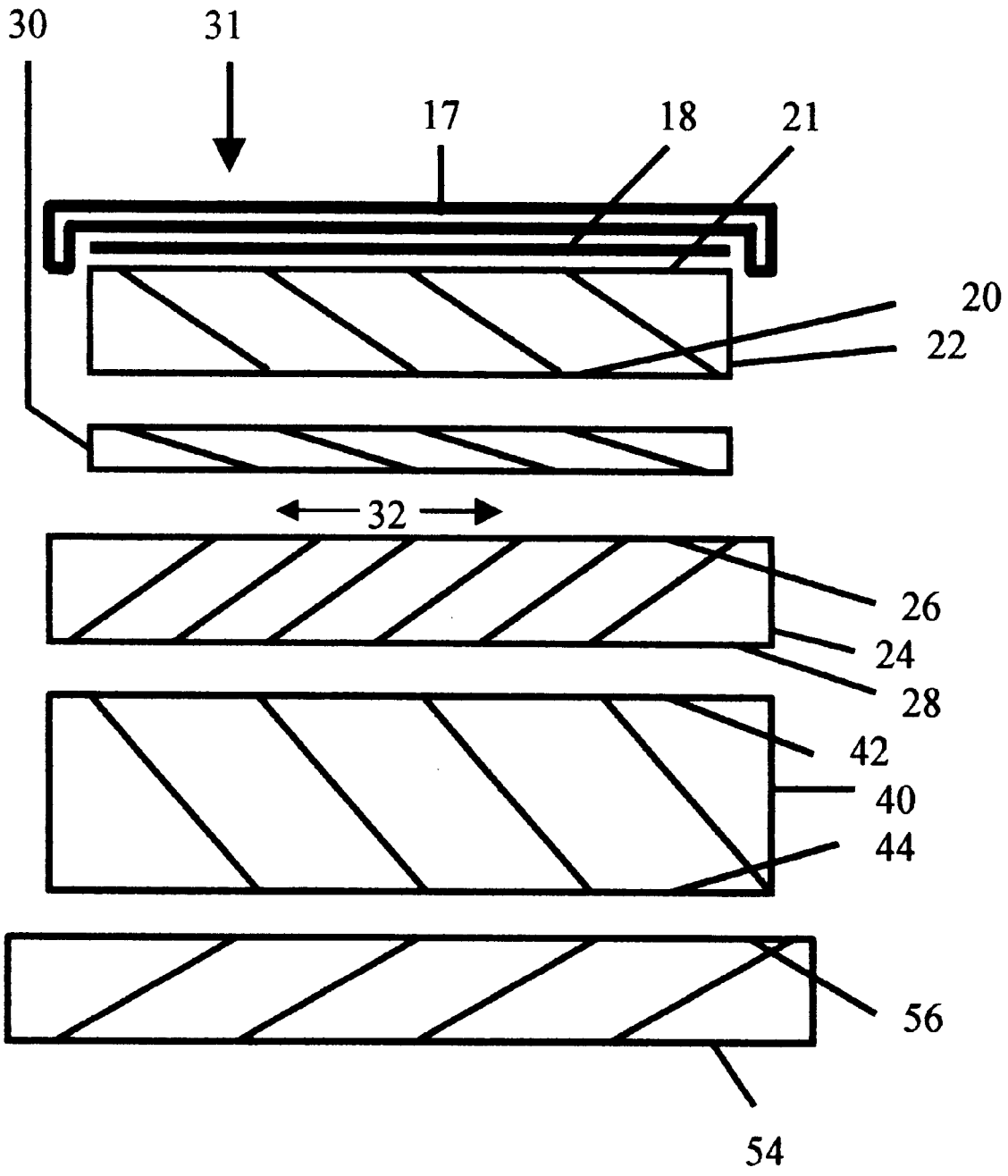
FIG. 3 is an close-up drawing of a preferred embodiment of this invention

FIG. 1 is an artist's drawing of a particularly preferred embodiment of this invention when looking from a top down perspective including the interrelationships of some important objects when finishing according to the method of this invention. Reference Numeral 24 represents the finishing element. Reference Numeral 26 represents the finishing element finishing surface. Reference Numeral 4 represents the direction of rotation of the finishing element finishing surface. Reference Numeral 20 represents the workpiece being finished. The workpiece surface facing the finishing element finishing surface is the workpiece surface being finished. Reference Numeral 6 represents the direction of rotation of the workpiece being finished. Reference Numeral 8 is the center of the rotation of the workpiece. Reference Numeral 10 represents an aqueous lubricating composition feed line for adding an aqueous lubricating composition to the workpiece surface to improve the quality of finishing. The aqueous lubricating composition feed line can have a plurality of exit orifices. An aqueous lubricating composition feed line supplies the aqueous lubricating composition adjacent or near the point of use is preferred. The aqueous lubricating composition feed line can also have other finishing chemicals such as acids, bases, buffers, finishing aids, and the like. The aqueous lubricating composition is preferably abrasive free. Thus the aqueous lubricating composition feed line is not limited to aqueous lubricating composition feeds but also feed other reagents and the like. Reference Numeral 12 represents a reservoir of aqueous lubricating composition to be fed to workpiece surface. An aqueous lubricating composition having a surfactant is preferred and having a hydrocarbon surfactant is more preferred and having at least two surfactants is even more preferred and having at least hydrocarbon surfactant and a hydrocarbon cosurfactant is even more particularly preferred. An aqueous lubricating composition having an organic boundary lubricant is preferred and having a polar organic boundary lubricant is even more preferred. When using a fixed abrasive finishing element, supplying an aqueous lubricating composition without abrasives is preferred and supplying aqueous lubricating composition free of abrasives is more preferred. When using a fixed abrasive finishing element, supplying a finishing composition without abrasives is preferred and supplying a finishing composition without abrasive particles is more preferred for some applications such as where a fixed abrasive finishing element finishing surface is used for finishing. Supplying a lubricant which is free of an encapsulating film or encapsulating thin resin structure is preferred. Encapsulating lubricants is an expensive and complex step which is unnecessary in this invention. Further, encapsulated lubricants tend to burst on breaking and can deliver higher than desired localized lubricants. The encapsulated lubricants can prematurely burst releasing their contents during manufacture of the slurry and/or finishing element. This can contaminate the slurry and/or finishing element and adversely affect their respective finishing performance. Not shown is the feed mechanism for the aqueous lubricating composition such as variable air or gas pressure or pump mechanism. Alternate reagents in the aqueous lubricating composition can be stored in the aqueous lubricating composition reservoir or mixed on the fly in the aqueous lubricating composition feed line. Reference Numeral 14 represents an alternate finishing composition feed line for adding other chemicals to the surface of the workpiece such as acids, bases, buffers, and other chemical reagents but it is preferably maintained free of abrasives in the feed. The alternate finishing composition of this invention is abrasive free. Thus both finishing composition and the alternate finishing compositions are preferably abrasive free. This reduces erosion to the fixed abrasive elements and prolongs the useful life of the fixed abrasive finishing element. Reference Numeral 16 represents a reservoir of alternate finishing composition to be fed to workpiece surface. Not shown is the feed mechanism for the alternate finishing composition such as a variable air or gas pressure or pump mechanism. A lubricant free of and separated from the abrasive particles is preferred. A lubricant free of and separated from unconnected to the abrasive particles is preferred. Another preferred embodiment, not shown, is to have a wiping element, preferably an elastomeric wiping element, to uniformly distribute the aqueous lubricating composition across the finishing element finishing surface. Nonlimiting examples of some preferred slurry dispensing systems and slurry wiping elements is found in U.S. Pat. No. 5,709,593 to Guthrie et. al., U.S. Pat. No. 5,246,525 to Junichi, and U.S. Pat. No. 5,478,435 to Murphy et. al. and are included herein by reference in their entirety for general guidance and appropriate modifications by those generally skilled in the art for supplying aqueous lubricating compositions. A separate feed for the aqueous lubricating composition and the alternate finishing composition is particularly preferred for some applications. The separate feed for the aqueous lubricating composition containing a preferred lubricant delivers the lubricant proximate to the point of use. The separate feed for the alternate finishing composition delivers the finishing composition proximate to the point of use. Alternately supplying the aqueous lubricating composition or alternate finishing composition through pores or holes in the finishing element finishing surface to effect a uniform distribution of the aqueous lubricating composition is also effective. FIGS. 2 and 3 will now provide an artists' expanded view of some relationships between the workpiece and the fixed abrasive finishing element.

FIG. 2 is an artist's close-up drawing of the interrelationships of some of the important aspects when finishing according to a preferred embodiment of this invention. Reference Numeral 20 represents the workpiece. Reference Numeral 21 represents the workpiece surface facing away from the workpiece surface being finished. Reference Numeral 22 represents the surface of the workpiece being finished. Reference Numeral 23 represents a high region (unwanted raised region) on the workpiece surface being finished. During finishing, the high region is preferably substantially removed and more preferably, the high region is removed and surface polished Reference Numeral 24 represents the finishing element. An abrasive finishing element is can be preferred for some applications. Reference Numeral 26 represents the surface of the finishing element facing the workpiece and is often referred to herein as the finishing element finishing surface. Reference Numeral 30 represents an aqueous lubricating composition and optionally, an alternate finishing composition disposed between the workpiece surface being finished and a finishing element finishing surface. An alternate finishing composition comprising a water based composition is preferred. An alternate finishing composition and finishing composition which are free of abrasive slurry particles are generally used in this invention. The workpiece surface being finished is in operative finishing motion relative to the finishing element finishing surface. The workpiece surface being finished in operative finishing motion relative to the finishing element finishing surface is an example a preferred operative finishing motion. Reference Numeral 32 represents a preferred operative finishing motion between the surface of the workpiece being finished and the finishing element finishing surface. Reference Numeral 33 represents a pressure applied to the operative interface perpendicular to the operative finishing motion.

FIG. 3 is an artist's close-up drawing of a preferred embodiment of this invention showing some further interrelationships of the different objects when finishing according to the method of this invention. Reference Numeral 16 represents a carrier for the workpiece and in this particular embodiment, the carrier is a rotating carrier. The rotating carrier is operable to rotate the workpiece against the finishing element which rests against the platen and optionally has a motor. Optionally, the rotating carrier can also be designed to move the workpiece laterally, in an arch, figure eight, or orbitally to enhance uniformity of polishing. The workpiece is in operative contact with the rotating carrier and optionally, has an operative contact element (Reference Numeral 18) to effect the operative contact. An illustrative example of an operative contact element is a workpiece held in place to the rotating carrier with a bonding agent (Reference Numeral 18). A hot wax is an illustrative example of a preferred bonding agent. Alternately, a porometric film can be placed in the rotating carrier having a recess for holding the workpiece. A wetted porometric film (Reference Numeral 18) will hold the workpiece in place by surface tension. An adherent thin film is another preferred example of placing the workpiece in operative contact with the rotating carrier. Reference Numeral 20 represents the workpiece. Reference Numeral 21 represents the workpiece surface facing away from the workpiece surface being finished. Reference Numeral 22 represents the surface of the workpiece being finished. Reference Numeral 24 represents the finishing element. Reference Numeral 26 represents the finishing element finishing surface. Reference Numeral 28 represents the surface of the finishing element facing away from the workpiece surface being finished. Reference Numeral 30 represents the aqueous lubricating composition and optionally, the alternate finishing composition supplied between the workpiece surface being finished and surface of the finishing element facing the workpiece. For some applications the alternate finishing composition and the aqueous lubricating composition can be combined into one feed stream and preferably remain free of abrasive slurry particles. The operative finishing interface remains free of supplied abrasive slurry particles in some preferred embodiments of this invention. Reference Numeral 31 represents a pressure, preferably a normal pressure, applied to the operative finishing interface. Reference Numeral 32 represents a preferred direction of the operative finishing motion between the surface of the workpiece being finished and the finishing element finishing surface. Reference Numeral 40 represents the platen or support for the finishing element. The platen can also have an operative finishing motion relative to the workpiece surface being finished. Reference Numeral 42 represents the surface of the platen facing the finishing element. The surface of the platen facing the finishing element is in support contact with the finishing element surface facing away from the workpiece surface being finished. The finishing element surface facing the platen can, optionally, be connected to the platen by adhesion. Frictional forces between the finishing element and the platen can also retain the finishing element against the platen. Reference Numeral 44 is the surface of the platen facing away from the finishing element. Reference Numeral 54 represents the base support structure. Reference Numeral 56 represents the surface of the base support structure facing the platen. The rotatable carrier (Reference Number 16) can be operatively connected to the base structure to permit improved control of pressure application at the workpiece surface being finished (Reference Numeral 22).

FIG. 4 is an artist's representation of a micro-region of the operative finishing interface showing some of the regions having an effective organic boundary lubrication and some of the regions being free of organic boundary lubrication. Reference Numeral 20 represents the workpiece being finished. Reference Numeral 24 represents the finishing element. Reference Numeral 26 represents the finishing element finishing surface. Reference Numeral 100 represents the effective organic boundary layer lubrication during finishing. The organic boundary layer lubrication does not effectively lubricate the entire workpiece surface being finished in this invention. Reference Numeral 101 represents regions where the workpiece surface is effectively free of organic boundary layer lubrication. Reference Numeral 102 represents regions where the workpiece surface is effectively lubricated with organic boundary layer lubrication. It is important to understand that organic boundary layer lubricated regions can be very small and the preferred organic boundary layer lubricant can be very thin, such as having from one to a few molecular layers of organic boundary layer lubricant. The regions and thickness of the organic boundary layer lubrication are not drawn to scale in this FIG. 4 in order to better illustrate particularly preferred aspects of organic boundary layer lubrication when finishing workpieces according to this invention.

Applicant currently believes that the higher number of defects than desirable in the workpiece surface being finished is due to the fact that the abrasive in a fixed abrasive finishing element can cause unwanted surface damage during finishing. Further, since the abrasive particles in a constant relative position versus the workpiece surface being finished, applicant believes they can become prematurely dull due to higher than necessary frictional forces. During finishing with an abrasive slurry feed, particularly when recycle is used, abrasive slurry particles can agglomerate, and cause unwanted workpiece surface damage. Organic boundary lubrication can reduce this unwanted workpiece surface damage. Still further, the finishing element finishing surface tends to have a higher coefficient of friction than necessary with the workpiece being finished which can lead to destructive surface forces on the workpiece surface being finished such as chatter. Larger workpieces such as 300 mm diameter semiconductor wafers can also experience higher than desired frictional forces during finishing. Each of the above situations can lead to less than desirable surface quality on the workpiece surface being finished and earlier than necessary wear on the expensive finishing element finishing surface. An operative finishing interface having an organic boundary lubricant can help to reduce these forces on large workpieces. Applicant currently believes that a marginal organic boundary lubricant layer to the interface of the workpiece surface being finished and the finishing element finishing surface can reduce or eliminate the high tendency to scratch and/or damage workpiece surface being finished. Applicant currently believes that supply of a marginal organic boundary lubricant layer to the interface of the workpiece surface being finished and the finishing element finishing surface can reduce or eliminate the negative effects of a high coefficient of friction such as chatter. Applicant currently believes that supply of a marginal organic boundary lubricant layer to the interface of the workpiece surface being finished and the finishing element finishing surface can extend the useful life of the finishing element finishing surface by reducing erosive forces. Applicant currently believes that supply of a preferred marginal organic boundary lubricant layer to the interface of the operative finishing interface can reduce the effective size of the abrasively removed particles from the workpiece thus improving surface finish and reducing surface defects while maintaining very good finishing rates. A preferred marginal organic boundary lubricant layer can help to reduce the wear to the tips of optional abrasive asperities on the finishing element finishing surface, preferably abrasive particles, due to attrition wear and tribochemical wear. A preferred marginal lubrication can also reduce the wear to abrasive slurry particles. Thus a marginal organic boundary lubricant layer can help to maintain the "cutting ability" of the abrasive asperities, preferably abrasive particles. Supplying the aqueous lubricating composition having an organic boundary lubricant free of abrasive slurry particles at the point of use reduces or prevents negative interactions between the alternate finishing composition and the aqueous lubricating composition such as causing instability in either the aqueous lubricating composition or alternate finishing composition. Supplying the aqueous lubricating composition having an organic boundary lubricant proximate to workpiece surface being finished is preferred. Supplying the aqueous lubricating composition separate from the alternate finishing composition minimizes or avoids the destabilizing effect the alternate finishing composition and/or the aqueous lubricating composition feed can have on each. This increases both aqueous lubricating composition and alternate finishing composition flexibility. Supplying an organic boundary lubricant to the operative finishing interface (located between finishing element finishing surface and the workpiece surface being finished) can further reduce chatter, micro localized distortions in the finishing element finishing surface, and increase the uniformity of finishing across the surface of the workpiece surface being finished. Forming the lubricating boundary layer differentially can improve local planarity and enhance finishing flexibility as discussed herein. Lubrication reduces abrasive wear to the abrasive particles and to the finishing element finishing surface by reducing friction forces. Differential boundary lubrication can enhance localized finishing rates to improve the semiconductor wafer surface. Preferred lubrication reduces breaking away of the abrasive particles from the surface of the abrasive finishing element by reducing friction forces. Preferred lubrication reduces the friction which reduces adverse forces particularly on a high speed belt finishing element which under high friction can cause belt chatter, localized belt stretching, and/or belt distortions, high tendency to scratch and/or damage workpiece surface being finished. Localized and/or micro localized distortions to the surface of a finishing element and chatter can also occur with other finishing motions and/elements and lubrication can reduce or eliminate these.

Supply of a marginal amount of aqueous lubricating composition having an organic boundary lubricant to the interface of the workpiece surface being finished and the finishing element finishing surface to extend the useful life of the finishing element finishing surface is preferred. Supply of a marginal amount of organic boundary lubricating layer to the interface of the workpiece surface being finished and the finishing element finishing surface to reduce unwanted surface defects in the workpiece surface being finished is preferred. Supply of a marginal amount of organic boundary lubricating layer to the interface of the workpiece surface being finished and the finishing element finishing surface to reduce unwanted breaking away of abrasive particles from the fixed abrasive finishing element finishing surface is preferred. A marginal amount of organic boundary lubricating layer often can help meeting a plurality of these objectives simultaneously.

Supply of lubricant to the interface of the workpiece surface being finished and the finishing element finishing surface to extend the finishing element finishing surface useful life is preferred. Supply of lubricant to the interface of the workpiece surface being finished and the finishing element finishing surface to reduce unwanted surface defects in the workpiece surface being finished is preferred. Supply of lubricant at the point of use is preferred and supply of lubricant in a substantially uniform way to the operative finishing interface at the point of use is currently more preferred. Supply of a thin lubricating boundary layer is particularly preferred. Supply of lubricant to the interface of the workpiece surface being finished and the finishing element finishing surface to reduce unwanted breaking away of large abrasive particles from the workpiece surface is preferred. An effective amount of boundary lubricant often can help meet a plurality of these advantages simultaneously.

The new problem recognition and unique solution are new and considered part of this current invention.

Finishing Element

A finishing element with or without fixed abrasives for finishing high precision workpieces is known and useful in this invention. As used herein a fixed abrasive finishing element is an integral abrasive finishing element. The integral abrasive finishing element having abrasive elements such as particles connected to at least the surface of the finishing element is preferred. The integral abrasive finishing element having abrasive particles connected to at least the surface of the finishing element and which is substantially free of unconnected abrasive particles except for those formed during the actual finishing process itself is more preferred. A three dimensional fixed abrasive finishing element as used herein is a fixed abrasive finishing element having multiple abrasive particles dispersed throughout at least as portion of its thickness such that if some of the surface is removed additional abrasive particles are exposed on the newly exposed surface.

A finishing element comprising at least one material selected from the group consisting of an organic synthetic resin, an inorganic polymer, and combinations thereof is preferred. A preferred example of organic synthetic resin is a thermoplastic resin. Another preferred example of an organic synthetic resin is a thermoset resin. Preferred examples of organic synthetic resins consist of materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl resins, polybutadienes, polyisoprenes, EPDM elastomers, and styrene butadiene elastomers. Preferred stiff finishing surfaces can comprise polyphenylene sulfide, polysulfone, and polyphenylene oxide polymers. Phenolic polymers can also be used. Copolymer resins are also preferred. Polyolefin resins are particularly preferred for their generally low cost. Polyurethanes are preferred for the inherent flexibility in formulations. A finishing element comprising a foamed organic synthetic resin is particularly preferred. Finishing elements comprising compressible and porous material are preferred.

A finishing element comprised of a synthetic resin composition is preferred. A finishing element comprising at least one layer of a soft synthetic resin is preferred. A finishing element comprising at least one layer of a elastomeric synthetic resin is preferred. A finishing element comprising at least one layer of a thermoset elastomeric synthetic resin is preferred.

When an abrasive finishing element is used, the fixed abrasive firmly attached to the finishing element finishing surface is preferred. The abrasive can be firmly attached to the finishing element finishing surface with known adhesives and/or mixed into a surface layer of a polymeric layer, preferably an organic polymeric layer. Particular abrasive surface topographies can be preferred for specific applications. Fixed abrasive finishing elements are generally known to those skilled in the art. Some nonlimiting examples include U.S. Pat. No. 4,966,245 to Callinan, U.S. Pat. No. 5,692,950 to Rutherford, U.S. Pat. No. 5,823,855 to Robinson, WO 98/06541 to Rutherford and WO 98/181159 to Hudson and are included herein by reference in their entirety for general guidance and modification of fixed abrasive finishing elements by those skilled in the art. Illustrative nonlimiting examples of fixed abrasive polishing pads for semiconductor wafers are commercially available 3M Co. and Sony Corporation.

An abrasive finishing element having abrasive asperities on the finishing element finishing surface is preferred. An abrasive finishing element having abrasive asperities having a height from 0.5 to 0.005 micrometers is preferred and an abrasive finishing element having abrasive asperities having a height from 0.3 to 0.005 micrometers is more preferred and an abrasive finishing element having abrasive asperities having a height from 0.1 to 0.01 micrometers is even more preferred and an abrasive finishing element having abrasive asperities having a height from 0.05 to 0.005 micrometers is more particularly preferred. The asperities are preferably firmly attached to the finishing element finishing surface and asperities which are an integral part of the finishing element finishing surface are more preferred. An abrasive finishing element having small asperities can finish a workpiece surface to fine tolerances.

Some illustrative nonlimiting examples of preferred finishing elements for use in the invention are also discussed. A finishing element having at least a layer of an elastomeric material having a Shore A hardness of at least 30 A is preferred. ASTM D 676 is used to measure harness. A porous finishing element is preferred to more effectively transfer the finishing composition to the surface of the workpiece being finished. A finishing element comprising a synthetic resin material is preferred. A finishing element comprising a thermoset resin material is more preferred. A finishing element having layers of different compositions is preferred to improve the operative finishing motion on the workpiece surface being finished. As an example, a finishing element having two layers, one a hard layer and one a soft layer, can better transfer the energy of the operative finishing motion to the workpiece surface being finished than a similar thickness finishing element of only a very soft layer. A thermoset synthetic resin is less prone to elastic flow and thus is more stable in this application. A finishing element which is thin is preferred because it generally transfers the operative finishing motion to the workpiece surface being finished more efficiently. A finishing element having a thickness from 0.5 to 0.005 cm is preferred and a thickness from 0.3 to 0.005 cm is more preferred and a finishing element having a thickness from 0.2 to 0.01 cm is even more preferred. Current synthetic resin materials can be made quite thin now. The minimum thickness will be determined by the finishing element's integrity and longevity during polishing which will depend on such parameters as tensile and tear strength. A finishing element having sufficient strength and tear strength for chemical mechanical finishing is preferred.

An finishing element having flex modulus in particular ranges is also preferred. An abrasive finishing element having a high flex modulus is generally more efficient for planarizing. An finishing element having a low flex modulus is generally more efficient for polishing. Further a continuous belt finishing element can have a different optimum flex modulus than a finishing element disk. One also needs to consider the workpiece surface to be finished in selecting the flex modulus. A finishing element comprising a synthetic resin having a flexural modulus of at most 1,000,000 psi is preferred and having flexural modulus of at most 800,000 psi is more preferred and at most 500,000 psi is more preferred. Flexural modulus is preferably measured with ASTM 790 B at 73 degrees Fahrenheit. Fixed abrasive finishing elements comprising a synthetic resin having a very low flex modulus are also generally known to those skilled in the art such as elastomeric polyurethanes which can also be used. A finishing element having a flexural modulus of greater than 1,000,000 psi can be preferred for some particular planarizing applications.

For some embodiments, polishing pad designs and equipment such as in U.S. Pat. No. 5,702,290 to Leach, a polishing pad having a high flexural modulus can be effective and preferred. A finishing element having a continuous phase of material imparting resistance to local flexing is preferred. A preferred continuous phase of material is a synthetic polymer, more preferably an organic synthetic polymer. An organic synthetic polymer having a flexural modulus of at least 20,000 psi is preferred and having a flexural modulus of at least 50,000 psi is more preferred and having a flexural modulus of at least 100,000 psi is even more preferred and having a flexural modulus of at least 200,000 psi is even more particularly preferred for the continuous phase of synthetic polymer in the finishing element. An organic synthetic polymer having a flexural modulus of at most 5,000,000 psi is preferred and having a flexural modulus of at most 3,000,000 psi is more preferred and having a flexural modulus of at most 2,000,000 psi is even more preferred for the continuous phase of synthetic polymer in the finishing element. An organic synthetic polymer having a flexural modulus of from 5,000,000 to 50,000 psi is preferred and having a flexural modulus of from 3,000,000 to 100,000 psi is more preferred and having a flexural modulus of at from 2,000,000 to 200,000 psi is even more preferred for the continuous phase of synthetic polymer in the finishing element. For some less demanding applications (such as die with a lower pattern density), a flexural modulus of at least 20,000 psi is preferred. These ranges of flexural modulus for the synthetic polymers provide useful performance for finishing a semiconductor wafer and can improve local planarity in the semiconductor. Flexural modulus is preferably measured with ASTM 790 B at 73 degrees Fahrenheit. Pounds per square inch is psi.

A finishing element having Young's modulus in particular ranges is also preferred. A finishing element having a high Young's modulus is generally more efficient for planarizing. A finishing element having a low Young's modulus is generally more efficient for polishing. Further, a continuous belt fixed abrasive finishing element can have a different optimum Young's modulus than a fixed abrasive finishing element disk. One also needs to consider the workpiece surface to be finished in selecting the Young's modulus. For a flexible finishing element, having a Young's modulus from 100 to 700,000 psi (pounds per square in inch) is preferred and one having a Young's modulus from 300 to 200,000 psi is more preferred and one having a Young's modulus from 300 to 150,000 psi is even more preferred. Particularly stiff finishing elements can have a preferred Young's modulus of at least 700,000 psi. For particularly flexible finishing elements, a Young's modulus of less than 200,000 psi is preferred and less than 100,000 psi is more preferred and less than 50,000 psi is even more preferred for some applications.

Young's Modulus for non-resilient materials is measured with particularly recommended methods. As used herein, resilience is related to the elastic rebound and stiffness in compression and also to the thickness of the material. Young's modulus of an organic polymer is measured by ASTM D638-84. For thin films, ASTM D882-88 can be used.

Young's Modulus for resilient materials is measured with a particularly recommended method. Dynamic compressive testing can be used to measure Young's Modulus in the thickness direction. For resilient materials, ASTM D5024-94 is used. The resiliency testing is carried out at 0.1 Hz at 20 degree centigrade with a preload of 34.5 kPa.

Illustrative preferred abrasive particles for use in a fixed abrasive finishing element comprise silica, silicon nitride, alumina, and ceria are preferred. Fumed silica is particularly preferred. A metal oxide is a type of preferred abrasive particle. A particularly preferred particulate abrasive is an abrasive selected from the group consisting of iron (III) oxide, iron (II) oxide, magnesium oxide, barium carbonate, calcium carbonate, manganese dioxide, silicon dioxide, cerium dioxide, cerium oxide, chromium (III) trioxide, and aluminum trioxide. Abrasive particles having an average diameter of less than 0.5 micrometers are preferred and less than 0.3 micrometer are more preferred and less than 0.1 micrometer are even more preferred and less than 0.05 micrometers are even more particularly preferred. Abrasive particles having an average diameter of from 0.5 to 0.01 micrometer are preferred and between 0.3 to 0.01 micrometer are more preferred and between 0.1 to 0.01 micrometer are even more preferred.

Abrasive particles having a different composition from the finishing element body are preferred. An abrasive particle having a Knoops hardness of less than diamond is particularly preferred to reduce microscratches on workpiece surface being finished and a Knoops hardness of less than 50 GPa is more particularly preferred and a Knoops hardness of less than 40 GPa is even more particularly preferred and a Knoops hardness of less than 35 GPa is especially particularly preferred. An abrasive particle having a Knoops hardness of at least 1.5 GPa is preferred and having a Knoops hardness of at least 2 is preferred. An abrasive particle having a Knoops hardness of from 1.5 to 50 GPa is preferred and having a Knoops hardness of from 2 to 40 GPa is preferred and having a Knoops hardness of from 2 to 30 GPa is even more preferred. A fixed abrasive finishing element having a plurality of abrasive particles having at least two different Knoops hardnesses can be preferred.

An organic boundary lubricant can be contained in the finishing element finishing surface and then supplied to the interface between the workpiece being finished and the finishing element finishing surface by the operative finishing motion. The interface between the workpiece being finished and the finishing element finishing surface is often referred to herein as the operative finishing interface. The boundary lubricant is preferably in discrete regions of the finishing element finishing surface. Some preferred boundary lubricants are discussed further herein below. Further details of secondary friction sensors and their use is found in a newly filed Patent Application with private serial number 1DTL11599 filed on Nov. 5, 1999 with PTO Serial Number 09/435,181 and having the title "In Situ Friction Detector for finishing semiconductor wafers" and it is included in its entirety for general guidance and modification of those skilled in the art. Alternately, the organic boundary lubricant can be delivered in the finishing composition, preferably in a fluid, and more preferably in a aqueous finishing composition. Both techniques have advantages in different finishing situations. These techniques can also be combined.

FIG. 8 is an artist's representation of finishing some unwanted raised regions and some regions below the unwanted raised regions. Reference Numeral 800 represents a portion of a semiconductor wafer surface having two unwanted raised regions. Reference Numeral 802 represents unwanted raised regions on the semiconductor surface being finished. Reference Numeral 804 represents lower local regions on the semiconductor surface being finished proximate to the unwanted raised regions. Reference Numeral 810 represents the finishing element finishing surface in local contact with the unwanted raised regions (Reference Numeral 802). Reference Numeral 812 represents the finishing element surface local region displaced from but proximate to and lower than the unwanted raised local regions. As shown the finishing element finishing surface can reduce pressure and/or lose actual contact with the lower local regions on the semiconductor proximate to the unwanted raised local regions. This leads to unwanted raised regions having higher pressure which in turn can reduce the lubricating boundary layer thickness in the unwanted raised regions. Reducing the boundary layer thickness generally increases local tangential friction forces, raises the finishing rate measured in angstroms per minute on the unwanted raised regions. Also the pressure in lower regions proximate to the unwanted raised regions have is lower pressure applied which in turn can increase lubricating boundary layer thickness in these lower regions. Increasing the lubricating boundary layer thickness generally decreases local tangential forces, lowering the finishing rate measured in angstroms per minute in these lower regions proximate to the unwanted raised regions. By increasing finishing rate in the unwanted raised regions and lowering the finishing rate in the proximate lower regions the planarity of the semiconductor is generally improved. This generally helps the unwanted raised regions to have higher finishing rates when measured in angstroms per minute and improves within die nonuniformity. As shown in the FIG. 4, the region of contact with the unwanted raised region is small which in turn raises the finishing pressure applied by the finishing elements having a higher flexural modulus and this increased pressure increases the finishing rate measured in angstroms per minute at the unwanted raised region. This higher pressure on the unwanted raised region also increases functional heat which can further increase finishing rate measured in angstroms per minute in the unwanted raised region. Boundary lubrication on the unwanted raised region can be reduced due to the higher temperature and/or pressure which further increases friction and finishing rate measured in angstroms per minute. Higher stiffness finishing element finishing surfaces apply higher pressures to the unwanted raised local regions which can further improve planarization, finishing rates, and within die nonuniformity. Finishing wherein the unwanted raised regions have a finishing rate measured in angstroms per minute of at least 1.6 times faster than in the proximate low local region measured in angstroms per minute is preferred and finishing wherein the unwanted raised regions have a finishing rate of at least 2 times faster than in the proximate low local region is more preferred and finishing wherein the unwanted raised regions have a finishing rate of at least 4 times faster than in the proximate low local region is even more preferred. Where there is no contact with the proximate low local region, the finishing rate in the low local region can be very small and thus the ratio between the finishing rate in the unwanted raised region to finishing rate in the low local region can be large. Finishing wherein the unwanted raised regions have a finishing rate measured in angstroms per minute of from 1.6 to 500 times faster than in the proximate low local region measured in angstroms per minute is preferred and finishing wherein the unwanted raised regions have a finishing rate of from 2 to 300 times faster than in the proximate low local region is more preferred and finishing wherein the unwanted raised regions have a finishing rate of from 2 to 200 times faster than in the proximate low local region is even more preferred and finishing wherein the unwanted raised regions have a finishing rate of from 4 to 200 times faster than in the proximate low local region is even more preferred. By finishing the unwanted raised regions at a faster rate, planarizing is improved.

By increasing the stiffness of the finishing element finishing surface, the pressure applied to the unwanted raised region can be increased. Flexural modulus as measured by ASTM 790 B at 73 degrees Fahrenheit is a useful guide to help raise the stiffness of a polymer finishing element. By adjusting the flexural modulus as measured by ASTM 790 B at 73 degrees Fahrenheit the pressure can be increased on the unwanted raised regions to increase finishing rates measured in Angstroms per minute. Applying at least two times higher pressure to the unwanted raised region when compared to the applied pressure in a lower region proximate to the unwanted raised region is preferred and applying at least three times higher pressure to the unwanted raised region when compared to the applied pressure in a lower region proximate to the unwanted raised region is more preferred and applying five times higher pressure to the unwanted raised region when compared to the applied pressure in a lower region proximate to the unwanted raised region is even more preferred. Because the lower region proximate the unwanted raised region can have a very low pressure, at most 100 times higher pressure in the unwanted raised regions compared to the pressure in a lower region proximate the unwanted raised region is preferred and at most 50 times higher pressure in the unwanted raised regions compared to the pressure in a lower region proximate the unwanted raised region is more preferred. By adjusting the flexural modulus of the finishing element finishing surface, lubricating boundary layer, and the other control parameters discussed herein, finishing and planarization of semiconductor wafer surfaces can be accomplished.

FIG. 9 is an artist's representation of an example of the effects on the boundary layer lubrication discussed herein above. As discussed herein, it is not drawn to scale so the boundary layer thickness can be illustrated in simple fashion for helpful guidance.

Reference Numeral 800 represents a cross-sectional view of a semiconductor wafer having two unwanted raised regions (Reference Numeral 802). Reference Numeral 804 represents a cross-sectional view of a semiconductor wafer having lower regions proximate to the two unwanted raised regions (Reference Numeral 802). Reference Numeral 900 represents the lubricating boundary layer. Reference Numeral 902 represents regions of partial or no local boundary layer lubrication (and generally with a higher coefficient of friction). In other words, Reference Number 902 represents regions having higher coefficients of friction and/or partial lubrication. Note that the regions of partial or no local organic boundary lubricating boundary layer can occur proximate to the unwanted raised regions on the semiconductor wafer surface being finished. Reference Numeral 904 represents a thicker region of lubricating boundary layer (and generally with lower coefficient of friction) which can generally occur in regions proximate to and below the unwanted raised regions and generally have lower coefficients of friction. Reference Numeral 810 represents a small cross-section of finishing element. The different local regions having different lubricating boundary layers and lubricating properties are referred to herein as differential boundary lubrication. Differential boundary lubrication can improve planarization for some semiconductor wafers (particularly at the die level).

FIG. 10 represents an artist's cross-sectional view of a preferred embodiment of a multi-layer finishing element according to this invention. Reference Numeral 33 represents the finishing element. Reference Numeral 26 represents the finishing element finishing surface. Reference Numeral 34 represents the synthetic resin particles proximate the finishing element finishing surface and dispersed in an optional the continuous phase of synthetic resin matrix. Preferably, but optionally, the synthetic resin particles are dispersed in the continuous phase synthetic resin matrix. In one preferred embodiment, the fixed abrasive particles are uniformly dispersed in the continuous phase synthetic resin matrix. In another preferred embodiment, the fixed abrasive particles can be dispersed in the continuous phase of synthetic resin. Optional abrasive particles can be added to finishing element surface to change the finishing characteristics of the finishing element. Abrasive particles can be dispersed in both the optional discrete synthetic resin particles and in the continuous phase of synthetic resin to advantage. Different abrasive particles dispersed in the continuous phase of synthetic resin and in the discrete synthetic resin particles is more preferred when abrasive particles are dispersed in both phases. By adjusting the type and location of the abrasive particles, the finishing element finishing characteristics can be adjusted to advantage for the workpiece being finished. Reference Numeral 35 represents the optionally preferred abrasive particles in a magnified view of the synthetic resin particles (Reference Numeral 34). Reference Numeral 36 represents the continuous phase of synthetic resin matrix. Reference numeral 37 represents a finishing element subsurface layer. A finishing element subsurface layer free of finishing aids, more preferably free of lubricant, is particularly preferred. A finishing element subsurface layer free of lubricant is often a lower cost, easier to manufacture, and can also have higher reinforcement ability. Reference Numeral 38 & 39 represent optional finishing aids dispersed in the continuous phase of synthetic resin matrix and discrete synthetic resin particles, respectively. A finishing element finishing surface layer having finishing aids dispersed in the continuous phase synthetic resin matrix is preferred and a finishing element finishing surface layer having finishing aids uniformly dispersed in the continuous phase synthetic resin matrix is more preferred. A finishing aid uniformly dispersed in the continuous phase synthetic resin matrix is a preferred type of dispersion. A finishing aid having a plurality of discrete regions in the continuous phase synthetic resin matrix is a particularly preferred form of dispersion and a finishing aid having dispersed discrete, unconnected finishing aid particles therein is a more particularly preferred form of dispersion in the continuous phase of synthetic resin matrix.

The organic boundary lubricant can be dispersed in the finishing element surface and transferred to the operative finishing interface during finishing. The lubricating aid can be contained in the finishing element body in different preferred forms. A lubricating aid dispersed in an organic synthetic polymer is preferred. A lubricating aid which is a liquid lubricant can be dispersed throughout the primary organic synthetic resin wherein the liquid lubricant effect of the binding of the fixed abrasive is carefully controlled. A fixed abrasive free of a lubricating coating is preferred and fixed abrasive particles free of a lubricating coating is more preferred. A lubricating aid dispersed in a minor amount of organic synthetic polymer which is itself dispersed in the primary organic synthetic polymer in discrete, unconnected regions is more preferred. As an illustrative example, a lubricant is dispersed in a minor amount of an ethylene vinyl acetate and then the ethylene vinyl acetate (having a lubricant) is dispersed in discrete, unconnected regions in a polyacetal resin. A lubricating aid dispersed in discrete, unconnected regions in an organic synthetic polymer is preferred. By dispersing the finishing aid and/or lubricating aids in a plurality of discrete, unconnected regions, their impact on the binding of the fixed abrasive in the body of the fixed abrasive element is reduced or eliminated.

Supplying an effective amount of organic boundary lubricant from the finishing element finishing surface layer which reduces the coefficient of friction between the finishing element finishing surface and the workpiece surface being finished is preferred. Supplying an effective amount of organic boundary lubricant from the finishing element finishing surface layer, more preferably a lubricating aid, which reduces the unwanted surface damage to the surface of the workpiece being finished during finishing is preferred. Supplying an effective amount of organic boundary lubricant from the finishing element finishing surface layer, more preferably a lubricating aid, which differentially lubricates different regions of the work piece and reduces the unwanted surface damage to at least a portion of the surface of the workpiece being finished during finishing is preferred.

Semiconductor Wafer

A semiconductor wafer needing finishing is preferred. A homogeneous surface composition is a semiconductor wafer surface having one composition throughout and is preferred for some applications. A semiconductor wafer needing polishing is preferred. A semiconductor wafer needing planarizing is especially preferred. A semiconductor wafer having a microelectronic surface is preferred. A semiconductor wafer surface having a heterogeneous surface composition is preferred A heterogeneous surface composition having different regions with different compositions on the surface is a preferred heterogeneous surface. A heterogeneous surface having different local topographies such as unwanted raised regions is a preferred heterogeneous surface. An example of a heterogeneous surface is a surface having regions of high conductivity and regions of lower conductivity. A heterogeneous surface uncovered during semiconductor wafer processing such as a heterogeneous interface having regions of high conductivity and lower conductivity is a preferred heterogeneous surface. Interlayer dielectric finishing and/or shallow trench isolation generally have heterogeneous surfaces generally known to those skilled in the semiconductor wafer CMP art. Damascene processed semiconductor wafers generally have heterogeneous surfaces generally known to those skilled in the semiconductor wafer CMP art. A semiconductor wafer having a microelectronic surface having both conductive regions and nonconductive regions is more preferred and is an example of a preferred heterogeneous workpiece surface. Illustrative examples of conductive regions can be regions having copper or tungsten and other known conductors, especially metallic conductors. Metallic conductive regions in the semiconductor wafer surface including metals selected from the group consisting of copper, aluminum, and tungsten or combinations thereof are particularly preferred. A semiconductor wafer having a conductive region comprising copper is preferred. A semiconductor wafer having a semiconductor wafer having a region of a material having a hardness of at most that of aluminum is preferred and of at most that of copper is more preferred. A semiconductor wafer having a conductive region having a hardness of at most 170 HV is preferred and of at most 140 HV is more preferred and of at most 120 HV is even more preferred. A semiconductor wafer having a region having a hardness of at most 170 HV is preferred and of at most 140 HV is more preferred and of at most 120 HV is even more preferred. A finishing composition can help prevent unwanted surface damage to these softer regions. A semiconductor device is a preferred workpiece. A substrate wafer is a preferred workpiece. A semiconductor wafer having a polymeric layer requiring finishing is preferred because an aqueous lubricating composition can be particularly helpful in reducing unwanted surface damage to the softer polymeric surfaces. An example of a preferred polymer is a polyimide. Polyimide polymers are commercially available from E. I. DuPont Co. in Wilmington, Del.

This invention is particularly preferred for semiconductor wafers requiring a highly flat surface. Finishing a semiconductor wafer surface to a surface to meet the specified semiconductor industry circuit design rule is preferred and finishing a workpiece surface to a surface to meet the 0.35 micrometers feature size semiconductor design rule is more preferred and finishing a semiconductor wafer surface to a surface to meet the 0.25 micrometers feature size semiconductor design rule is even more preferred and finishing a semiconductor wafer surface to a to meet the 0.18 micrometers semiconductor design rule is even more particularly preferred. An electronic wafer finished to meet a required surface flatness of the wafer device rule to be used in the manufacture of ULSIs (Ultra Large Scale Integrated Circuits) is a particularly preferred semiconductor wafer made with a method according to preferred embodiments of this invention. The design rules for semiconductors are generally known to those skilled in the art. Guidance can also be found in the "The National Technology Roadmap for Semiconductors" published by SEMATECH in Austin, Tex. Supplying an aqueous lubricating composition to a semiconductor wafer having a diameter of at least 200 mm is preferred and supplying an aqueous lubricating composition to a semiconductor wafer having a diameter of at least 300 mm is more preferred. Supplying an aqueous lubricating composition having a lubricant to a semiconductor wafer having a diameter of at least 200 mm is even more preferred and supplying aqueous lubricating having a lubricant to a semiconductor wafer having a diameter of at least 300 mm is more preferred. Large semiconductor wafers can generally be finished more effectively with an aqueous lubricating composition, particularly one having lubricant. Friction and heat generation can be more effectively controlled.

Alternate Finishing Composition

Alternate Comp compositions are generally known for fixed abrasive finishing. A chemical mechanical polishing slurry which has the abrasive particles removed can also be used as an finishing composition and an alternate finishing composition in this invention. Alternately, a CMP slurry can be modified by those skilled in the art by removing the abrasive particles to form a finishing composition free of abrasive particles. An alternate finishing composition free of abrasive particles is preferred. Alternate finishing compositions have their pH adjusted carefully, and generally comprise other chemical additives which are used to effect chemical reactions and/other surface changes to the workpiece. An alternate finishing composition having dissolved chemical additives is particularly preferred. Illustrative examples of preferred dissolved chemical additives include dissolved acids, bases, buffers, oxidizing agents, reducing agents, stabilizers, and chemical reagents. An alternate finishing composition which substantially reacts with material from the semiconductor wafer surface being finished is particularly preferred. An alternate finishing composition which selectively chemically reacts with a portion of the semiconductor wafer surface is particularly preferred. An alternate finishing composition which preferentially chemically reacts with only a portion of the semiconductor wafer surface is particularly preferred.

Some illustrative nonlimiting examples of CMP slurries which can be modified by those skilled in the art are now discussed. An example slurry comprises water, a solid abrasive material and a third component selected from the group consisting of $HNO_3$, $H_2SO_4$, and $AgNO_3$ or mixtures thereof. Another polishing slurry comprises water, aluminum oxide, and hydrogen peroxide mixed into a slurry. Other chemicals such as KOH (potassium hydroxide) can also be added to the above polishing slurry. Still another illustrative polishing slurry comprises $H_3PO_4$ at from about 0.1% to about 20% by volume, $H_2O_2$ at from 1% to about 30% by volume, water, and solid abrasive material. Still another polishing slurry comprises an oxidizing agent such as potassium ferricyanide, an abrasive such as silica, and has a pH of between 2 and 4. Still another polishing slurry comprises high purity fine metal oxide particles uniformly dispersed in a stable aqueous medium. Still another polishing slurry comprises a colloidal suspension of $SiO_2$ particles having an average particle size of between 20 and 50 nanometers in alkali solution, demineralized water, and a chemical activator. U.S. Pat. No. 5,209,816 to Yu et. al. issued in 1993, U.S. Pat. No. 5,354,490 to Yu et al. issued in 1994, U.S. Pat. No. 5,408,810 to Sandhu et. al. issued in 1996, U.S. Pat. No. 5,516,346 to Cadien et. al. issued in 1996, U.S. Pat. No. 5,527,423 to Neville et. al. issued in 1996, U.S. Pat. No. 5,622,525 to Haisma et. al. issued in 1997, and U.S. Pat. No. 5,645,736 to Allman issued in 1997 comprise illustrative nonlimiting examples of slurries contained herein for further general guidance and modification by those skilled in the arts. Commercial CMP polishing slurries are also available from Rodel Manufacturing Company in Newark, Del. Application WO 98/18159 to Hudson gives general guidance for those skilled in the art for modifying current slurries to produce an abrasive free finishing compositions and alternate finishing compositions.

The finishing and alternate finishing composition is preferably free of abrasive particles in their feed streams when an abrasive finishing element is used. However as the fixed abrasive finishing element wears down during finishing, some naturally worn fixed abrasive particles can be liberated from the fixed abrasive finishing element can thus temporarily be present in the alternate finishing composition until drainage or removal. An organic boundary layer lubrication covering a surface area fraction of at least 0.75 of the workpiece can help reduce unwanted surface damage from these liberated fixed abrasive particles until drainage or removal.

Marginal Lubrication

As used herein, the coefficient of friction is defined in the normal manner, that is the coefficient of friction (COF) is equal to the friction force (ff) divided by the load (L). As used this specification a marginal organic boundary lubrication layer is a term used to describe a surface which effectively has at least one region which has an effective boundary lubrication layer and at least one region which is effectively free of a boundary lubrication layer. An Effective Coefficient of Friction (ECOF) is a term used herein to help define and control marginal lubrication. An equation will now be given which defines Effective Coefficient of Friction as used herein.

$$\text{i ECOF}=(COF_LF)(LFF)+(1-LFF)(COF_L)$$

where:

ECOF=effective coefficient of friction

LFF=organic boundary layer Lubricant Free Fraction of the surface area

COF_LF=coefficient of friction for surface lubricant free (free of organic boundary layer lubricant)

COF—L=coefficient of friction for surface with lubricant (having an organic boundary layer lubricant)

To further illustrate, an example will now be given. To further illustrate, an organic boundary lubricant layer free region has a COF_LF of 0.5 and an LFF (organic boundary layer Lubricant Free Fraction of the surface area) of 0.15. In the example a organic boundary lubricant layer region has a COF_L of 0.1 and looking to the equation above, the organic boundary layer lubricant covers a surface area fraction of 0.85. Further, the ECOF is calculated to be 0.16. Thus the ECOF is sensitive to changes in the COF_LF, COF_L, and the LFF. FIG. 5 is a calculated graph of the change of the Effective Coefficient of Friction versus the fraction of the operative finishing surface interface which is free of an organic boundary lubricant wherein the coefficient of friction for the organic boundary layer lubricated semiconductor wafer surface is 0.1 and the coefficient of friction for the semiconductor wafer surface free of organic boundary lubricant is 0.5. If a heterogeneous semiconductor wafer surface is being finished, the proper terms for each of the uniform regions on the surface are defined and can be used by those skilled in the art. A secondary friction sensor and resulting calculations from a process can be used to advantage to selectively control the ECOF in a designated region or type of region as will be discussed herein below. Finishing in preferred value ranges of the effective coefficient of friction is an important aspect of this invention. Using the effective coefficient of friction to manage, control, and improve finishing results by reducing unwanted surface defects and improving semiconductor wafer processing costs is an important preferred embodiment of this invention. Using the effective coefficient of friction to control in situ, real time finishing is particularly preferred.

This change in the Effective Coefficient of Friction can be used as a preferred control parameter to optimize both quality of the semiconductor surface being finished and the finishing rate as well as the cost of ownership to finish the semiconductor wafer surface. The finishing rate can be calculated to show an expected normalized finishing rate as a function of the change in the fraction of the operative finishing surface interface which is free of an organic boundary lubricant. The results of these calculations are shown in FIG. 6. It is important to note that finishing rate is non linear. There is a surprising increase in finishing rate in the non organic boundary lubrication workpiece surface area fraction from about 0.001 to 0.25. Another important consideration is the quality of the semiconductor surface being finished. Large workpiece particles removed during the operative finishing motion can scratch, gouge, or otherwise damage the workpiece surface during finishing. Therefore, it is important to reduce the size of the workpiece particles removed during the operative finishing motion. Further, the quality of the surface finish is generally related to the size of the workpiece particles removed during the operative finishing motion. The relative abraded particle size on a non lubricated surface to the abraded particle size on an organic boundary lubricated surface as a function of the fraction of the surface area free of organic boundary layer lubrication is shown in FIG. 7. As can be seen in FIG. 7, the ratio of the non lubricated abraded workpiece particle size (average mean diameter) to the abraded workpiece particle size (average mean diameter) from a partial organic boundary lubricated surface varies with the fraction of surface area free of boundary lubrication. The average mean workpiece particle diameter size removed during finishing increases surprisingly rapidly as the fraction of the semiconductor wafer surface free of organic boundary layer lubrication increases.

Partial organic boundary layer lubrication is preferred for fixed abrasive finishing. As used herein, partial organic boundary lubrication is where a workpiece surface has an area(s) which has an organic boundary layer lubrication and that same surface has an area(s) which is free of organic boundary layer lubrication. FIG. 4 is an artist's representation of a partial organic boundary layer lubrication. A careful review of FIGS. 5, 6, and 7 show an unexpected and preferred range of partial organic boundary lubrication for semiconductor wafers. To optimize, for instance, finishing rate and semiconductor surface quality, different values are preferred. An operative finishing interface having from 0.001 to 0.25 fraction of the semiconductor wafer surface free of organic boundary lubrication for at least a portion of the finishing cycle is preferred and having from 0.05 to 0.20 fraction of the semiconductor wafer surface free of organic boundary lubrication for at least a portion of the finishing cycle is more preferred and having from 0.01 to 0.15 fraction of the semiconductor wafer surface free of organic boundary lubrication for at least a portion of the finishing cycle is even more preferred and having from 0.02 to 0.15 fraction of the semiconductor wafer surface free of organic boundary lubrication for at least a portion of the finishing cycle is even more particularly preferred. Finishing the semiconductor wafer surface using a method which is effectively free of organic boundary layer lubrication with from 5% to 95% of the finishing cycle time is preferred and one with from 20 to 100% of the finishing cycle time is more preferred and one with 40 to 100% of the finishing cycle time is even more preferred. These unexpected ranges help reduce unwanted surface defects and give good finishing rates.

Apparent partial organic boundary layer lubrication is preferred for fixed abrasive finishing. As used herein, apparent partial organic boundary lubrication is where a workpiece surface has an area(s) acts as if it has an organic boundary layer lubrication and that same surface has an area(s) which is free of organic boundary layer lubrication and the coefficient of friction changes with the pressure (see FIG. 3, Reference Numeral 31) applied to the operative finishing interface. FIG. 4 is an artist's representation of a partial organic boundary layer lubrication. To improve the finishing rate and semiconductor surface quality, different effective partial organic boundary layer lubrication values are preferred. An operative finishing interface with an apparent partial organic boundary layer lubrication having from 0.001 to 0.25 fraction of the semiconductor wafer surface effectively free of organic boundary lubrication for at least a portion of the finishing cycle is preferred and having from 0.05 to 20 fraction of the semiconductor wafer surface effectively free of organic boundary lubrication for at least a portion of the finishing cycle is more preferred and having from 0.01 to 15 fraction of the semiconductor wafer surface effectively free of organic boundary lubrication for at least a portion of the finishing cycle is even more preferred and having from 0.02 to 15 fraction of the semiconductor wafer surface effectively free of organic boundary lubrication for at least a portion of the finishing cycle is even more particularly preferred. These unexpected ranges help reduce unwanted surface defects and good finishing rates.

Control of finishing control parameters to finish semiconductor wafers within these preferred partial organic boundary layer lubrication values for a substantial amount of the finishing cycle time is preferred and control of finishing control parameters to finish semiconductor wafers within these preferred partial organic boundary layer lubrication values for from 20% to 100% of the finishing cycle time is more preferred and control of finishing control parameters to finish semiconductor wafers within these preferred partial organic boundary layer lubrication values for from 40 to 100% of the finishing cycle time is even more preferred. When particularly aggressive finishing is needed for a part of the finishing cycle time, control of the finishing control parameters from 5 to 95% of the finishing cycle time is preferred. Use of in situ process control to control of the finishing control parameters to finish semiconductor wafers within these preferred partial organic boundary layer lubrication values for a substantial amount of the finishing cycle time is preferred and control of finishing control parameters to finish semiconductor wafers within these preferred partial organic boundary layer lubrication values for from 20% to 100% of the finishing cycle time is more preferred and control of finishing control parameters to finish semiconductor wafers within these preferred partial organic boundary layer lubrication values for from 40 to 100% of the finishing cycle time is even more preferred Use of in situ process control with in situ detectors to control of the finishing control parameters to finish semiconductor wafers within these preferred partial organic boundary layer lubrication values for a substantial amount of the finishing cycle time is preferred and control of finishing control parameters to finish semiconductor wafers within these preferred partial organic boundary layer lubrication values for from 20% to 100% of the finishing cycle time is more preferred and control of finishing control parameters to finish semiconductor wafers within these preferred partial organic boundary layer lubrication values for from 40 to 100% of the finishing cycle time is even more preferred. Use of in situ process control with in situ detectors and a processor which at least in part calculates a term related to the effective coefficient of friction to aid control the finishing control parameters to finish semiconductor wafers within these preferred partial organic boundary layer lubrication values for a substantial amount of the finishing cycle time is preferred and control of finishing control parameters to finish semiconductor wafers within these preferred partial organic boundary layer lubrication values for from 20% to 100% of the finishing cycle time is more preferred and control of finishing control parameters to finish semiconductor wafers within these preferred partial organic boundary layer lubrication values for from 40 to 100% of the finishing cycle time is even more preferred. Use of in situ process control with in situ detectors and a processor which at least in part calculates a effective coefficient of friction to aid control the finishing control parameters to finish semiconductor wafers within these preferred partial organic boundary layer lubrication values for a substantial amount of the finishing cycle time is preferred and control of finishing control parameters to finish semiconductor wafers within these preferred partial organic boundary layer lubrication values for from 20% to 100% of the finishing cycle time is more preferred and control of finishing control parameters to finish semiconductor wafers within these preferred partial organic boundary layer lubrication values for from 40 to 100% of the finishing cycle time is even more preferred. By controlling the finishing process within preferred levels and finishing times, unwanted surface defects are generally reduced.

As discussed herein, preferred semiconductor wafer surfaces can be heterogeneous. A heterogeneous semiconductor preferably has different uniform regions such as conductive regions and non-conductive regions. During finishing it is often the case that one of the uniform regions is particularly important during finishing. Also, because of differences such as surface energy, preferred marginal lubrication may be more important for one uniform region or the other uniform region. A preferred uniform region in some applications is the conductive region. A preferred uniform region in some applications is the non-conductive region. The priority is preferably judged on such parameters as desired finishing rates and surface quality. An operative finishing interface having from 0.1 to 25% of a uniform region of semiconductor wafer surface effectively free of organic boundary lubrication for at least a portion of the finishing cycle is preferred and having from 0.1 to 20% of a uniform region of the semiconductor wafer surface effectively free of organic boundary lubrication for at least a portion of the finishing cycle is more preferred and having from 0.5 to 15% of a uniform region of the semiconductor wafer surface effectively free of organic boundary lubrication for at least a portion of the finishing cycle is even more preferred and having from 1 to 12% of a uniform region of the semiconductor wafer surface effectively free of organic boundary lubrication for at least a portion of the finishing cycle is preferred.

Finishing a semiconductor wafer in an operative finishing interface having a percentage of the surface effectively free of organic boundary lubrication is new and unique to this invention. This method of finishing can improve the balance of finishing rate and surface quality in unexpected ways.

Lubricating Compositions

Lubricating compositions can be preferred for finishing when a finishing pad finishing surface is employed for finishing semiconductor wafer surfaces. An aqueous lubricating composition is preferred. An aqueous lubricating composition can lubricate the semiconductor wafer surface to reduce unwanted damage during finishing and advantageously change selectively during semiconductor wafer processing. An aqueous dispersion composition having solid organic lubricating particles is a preferred aqueous lubricating composition. An aqueous emulsion composition having liquid organic lubricating droplets is a preferred aqueous lubricating composition. An aqueous composition having soluble organic lubricating aids is a preferred aqueous lubricating composition. An aqueous lubricating composition is preferred because of environmental friendliness reasons. An aqueous lubricating composition can also reduce concerns for contamination in the clean room fabrication of semiconductor wafers.

A separate feed of an aqueous lubricating compositions is preferred because, for instance, lubricant concentrations and feed rates can be controlled and changed easily and accurately. A method to add aqueous lubricating compositions, more preferably having a boundary lubricant, in a fluid can be particularly preferred because the amount and timing can be controlled to best effect for the particular finishing at hand. An aqueous lubricating composition is preferred because it is more environmentally friendly when compared to a non aqueous lubricating composition. An aqueous lubricating composition can also reduce concerns for contamination in the clean room fabrication of semiconductor wafers as compared to a non aqueous lubricating composition. Further, if a lubricating dispersion is used, some of the lubricants can be filtered out of a used or spent finishing composition before recycling and/or discarding. A soluble lubricating agent or a liquid lubricating agent cannot be filtered from a spent finishing composition before recycling and/or discarding. An aqueous lubricating composition formed with purified water is preferred and one formed from deionized water is particularly preferred. An aqueous lubricating composition formed with water which has low sodium content is also preferred because sodium can have an adverse performance effect on the preferred semiconductor parts being made. An aqueous lubricating composition free of sodium is preferred. As used herein an aqueous lubricating composition free of sodium means that the sodium content is below the threshold value of sodium which will adversely impact the performance of a semiconductor wafer or semiconductor parts made therefrom. An aqueous lubricating composition formed with pure water is preferred for particular types of finishing, especially for heterogeneous semiconductor surfaces. For general guidance, water having a resistance of at least 18 M ohms is preferred and deionized water having a resistance of at least 18 M ohms is more preferred. The preparation and monitoring of water quality is generally known to those skilled in the semiconductor wafer processing art.

An aqueous lubricating composition having a boundary lubricant is preferred. A boundary lubricant comprising a reactive boundary lubricant is preferred. A reactive boundary lubricant is a lubricant which chemically reacts with the workpiece surface being finished. A boundary lubricant forms a preferred lubricating layer or film on at least a portion of the workpiece surface being finished. As used herein, a boundary lubricant is a thin layer on one or more surfaces which prevents or at least limits, the formation of strong adhesive forces between the workpiece being finished and the finishing element finishing surface and therefore limiting potentially damaging friction junctions between the workpiece surface being finished and the finishing element finishing surface. A boundary lubricant layer has a comparatively low shear strength in tangential loading which reduces the tangential force of friction between the workpiece being finished and the finishing element finishing surface which can reduce surface damage to the workpiece being finished. A boundary lubricant layer which reduces the tangential force of friction between the workpiece being finished and the finishing element finishing surface is preferred. In other words, boundary layer lubrication is a lubrication in which friction between two surfaces in relative motion, such as the workpiece surface being finished and the finishing element finishing surface, is determined by the properties of the surfaces, and by the properties of the lubricant other than the viscosity. A boundary lubricant preferably forms a boundary lubricating layer, perhaps even several molecules thick, and the boundary lubricant layer formation depends on the physical and chemical interactions with the surface and the motion at the interface such as the operative finishing interface. Organic lubrication layers wherein the friction between two surfaces is dependent on lubricant properties other than viscosity is preferred. Different regional boundary layers on a semiconductor wafer surface being finished can be preferred for some finishing—particularly planarizing. An organic boundary lubricant which forms of thin layer or film is preferred. A boundary lubricant forming a lubricating layer having a thickness from 1 to 10 molecules thick is preferred and a boundary lubricant forming a film having a thickness from 1 to 6 molecules thick is more preferred and a boundary lubricant forming a film having a thickness from 1 to 4 molecules thick is even more preferred. A boundary lubricant forming a film having a thickness from 1 to 10 molecules thick on at least a portion of the workpiece surface being finished is particularly preferred and a boundary lubricant forming a film having a thickness from 1 to 6 molecules thick on at least a portion of the workpiece surface being finished is more particularly preferred and a boundary lubricant forming a film having a thickness from 1 to 4 molecules thick on at least a portion of the workpiece surface being finished is even more particularly preferred. A boundary lubricant forming a film having a thickness of at most 10 molecules thick on at least a portion of the workpiece surface being finished is preferred and a boundary lubricant forming a film having a thickness of at most 6 molecules thick on at least a portion of the workpiece surface being finished is more preferred and a boundary lubricant forming a film having a thickness of at most 4 molecules thick on at least a portion of the workpiece surface being finished is even more preferred and a boundary lubricant forming a film having a thickness of at most 2 molecules thick on at least a portion of the workpiece surface being finished is even more preferred. An operative motion which continues in a substantially uniform direction can improve boundary layer formation and lubrication. A discontinuous operative motion can be used to change the lubricating boundary layer. The operative finishing motion can also influence the formation and stability to the lubricating boundary layer on the workpiece surface being finished. An operative finishing motion which continues in a substantially uniform direction can improve boundary layer formation and lubrication.

The molecular thickness of lubricating boundary layers can be measured with generally known frictional force measures and/or energy change sensors discussed herein. Changing the pressure in the operative finishing interface and/or in the secondary friction sensor interface can be used to determine molecular thickness. Controls can also be used by using various generally known analytical techniques such as spectroscopy and these results can be used to calibrate target energy change sensors and frictional force measures. Thermal analysis can also be used to measure the quantity of organic boundary layer on a surface and then calculating the thickness. Thermal analysis can be used to determine the efficacy of a particular lubricating boundary layer including solid boundary lubricant zone, boundary liquid lubricant zone, and boundary lubricant desorbed zone and the transition temperatures therebetween.

Heterogeneous lubricating boundary layers can improve finishing and planarizing of some semiconductor wafers where a differential finishing rate is desired in different regions. A semiconductor wafer surface having at least one unwanted raised region wherein the lubricating boundary layer thickness is at most one half the molecular layer thickness of the lubricating boundary layer thickness proximate to the unwanted raised region is preferred. A semiconductor wafer surface having at least one unwanted raised region wherein the boundary lubrication thickness is at most one third the molecular layer thickness of the lubricating boundary layer thickness proximate to the unwanted raised region is more preferred. A semiconductor wafer surface having at least one unwanted raised region wherein the lubricating boundary layer thickness is at most one quarter the molecular layer thickness of the lubricating boundary layer thickness proximate to the unwanted raised region is more preferred. Applications of this technology are further discussed herein elsewhere.

Controlling the thickness of the lubricating boundary layer by changing at least one control parameter in a manner that changes the tangential force of friction in at least one region of the semiconductor wafer surface in response to an in situ control signal is preferred. Controlling the thickness of the lubricating boundary layer by changing at least one control parameter in a manner that changes the tangential force of friction in at least two different regions of the semiconductor wafer surface in response to an in situ control signal is more preferred. Preferably the unwanted raised regions are related to a repeating pattern in the semiconductor wafer die. A plurality of die each having the same repeating pattern on the semiconductor wafer surface being finished is more preferred. These repeating patterns are generally created during semiconductor wafer manufacture and can be related to pattern densities. This is because small changes in lubricating boundary layers can change finishing rate, finishing rate selectivity, and finished surface quality.

A reactive boundary lubricant is a preferred lubricant. A lubricating boundary layer comprising physical adsorption (physisorption) of the lubricant molecules to the semiconductor surface being finished is a preferred lubricating boundary layer. Van der Waals surface forces are a preferred example of physical adsorption. Dipole-dipole interaction between the boundary lubricant and the semiconductor wafer surface being finished is a preferred example of physical adsorption. A reversible dipole-dipole interaction between the boundary lubricant and the semiconductor wafer surface is an example of a more preferred physical adsorption lubricating boundary layer. An organic alcohol is an illustrative preferred example. A polar organic molecule containing the heteroatom oxygen is preferred. An organic boundary lubricating layer which is a solid film generally has a greater ability to separate the finishing element finishing surface from the semiconductor wafer surface being finished. A heat of adsorption of from 2,000 to 10,000 cal/mole is preferred for physisorption. A physisorption organic boundary lubricating layer is a preferred reversible lubricating layer.

A lubricating boundary layer comprising chemisorption of lubricant molecules to the semiconductor wafer being finished is a preferred lubricating boundary layer. In chemisorption, chemical bonds hold the boundary lubricants to the semiconductor wafer surface being finished. As an illustrative example, a reaction of stearic acid forms a "metal soap" thin film on a metal surface. An organic carboxylic acid is a preferred example. Further, the "metal soap" can have a higher melting temperature and thus form regional areas of an organic boundary layer having higher temperature lubricating capacity as discussed further herein below. A heat of absorption of between 10,000 to 100,000 cal/mole is preferred for chemisorption.

A solid film organic boundary lubricating layer generally has a greater ability to separate the finishing element finishing surface from the semiconductor wafer surface being finished. A solid film organic boundary lubricating layer can thus help reduce finishing rates as measured in angstroms per minute (compared to a liquid film), A liquid film organic boundary lubricating layer generally has a lower ability to separate the finishing element finishing surface from the semiconductor wafer surface being finished can thus help increase finishing rates as measured in angstroms per minute (compared to a solid film). The same boundary lubricant can form either a solid film organic boundary lubricating layer or a liquid film organic boundary lubricating layer depending on the operative finishing interface process conditions. A reversible organic boundary lubricating layer (which can change from solid to liquid to solid depending on processing conditions such as temperature) is preferred. Finishing a heterogeneous semiconductor wafer surface having at least one unwanted raised region wherein the lubricating boundary layer comprises a liquid film on the unwanted raised region and the lubricating boundary layer comprises a solid film in the region below and proximate to the unwanted raised region is preferred. Finishing a heterogeneous semiconductor wafer surface having at least one unwanted raised region wherein the lubricating boundary layer comprises a higher temperature liquid film on the unwanted raised region and the lubricating boundary layer comprises a lower temperature solid film in the region below and proximate to the unwanted raised region is preferred. Applying an operative finishing motion to the operative finishing interface forming a heterogeneous temperature profile on the semiconductor wafer surface being finishing and wherein the temperature is higher on a plurality of unwanted raised regions of the heterogeneous semiconductor wafer surface and the temperature is lower proximate to and below the plurality of unwanted raised regions of the heterogeneous semiconductor wafer surface and further the plurality of unwanted raised regions have a liquid lubricating films on them and the regions proximate to and below the plurality of unwanted raised regions have solid lubricating films on them. See for instance Reference Numerals 802 (unwanted raised region) and 804 (region proximate to and below the unwanted raised region) for further helpful guidance. An example is octadecyl alcohol which forms a solid lubricant film on copper at about 20 to 55 degrees centigrade and a liquid film on copper at about 65 to 110 degrees centigrade. An organic boundary lubricating layer that is capable of changing from a solid film to a liquid film in the operative finishing interface temperature range during a finishing cycle time is preferred. An organic boundary lubricating layer that is capable of changing from a solid film to a different physical form in the operative finishing interface temperature range during a finishing cycle time is preferred. An organic boundary lubricating layer that is capable of changing from a liquid film to a different physical form in the operative finishing interface temperature range during a finishing cycle time is preferred. An organic boundary lubricating layer that is capable of changing from a solid film to a liquid film in the temperature range from 20 to 100 degrees centigrade is more preferred. By increasing the finishing rate in the unwanted raised region and lowering the finishing rate in the region proximate to and below the unwanted raised region, planarization can be improved. Changing the lubricating boundary layer film's physical form by changing at least one lubrication control parameter in situ based on feed back information from a lubrication control subsystem having an energy change sensor is preferred. Controlling the lubricating boundary layer film's physical form by changing at least one lubrication control parameter in situ based on feedback information from a lubrication control subsystem having an energy change sensor is more preferred. Increasing temperature on the unwanted raised region on the semiconductor wafer surface compared to the temperature on the region below the unwanted raised region forming the lubricating boundary layer liquid film on the unwanted raised region and the lubricating boundary layer solid film on at least a portion of the semiconductor wafer surface below the raised region is preferred. Increasing temperature with frictional heat on the unwanted raised region on the semiconductor wafer surface compared to the temperature on the region below the unwanted raised region forming the lubricating boundary layer liquid film on the unwanted raised region and the lubricating boundary layer solid film on at least a portion of the semiconductor wafer surface below the raised region is more preferred. Using and controlling the lubricating boundary layer's physical form can help customize finishing for the particular semiconductor wafers needing finishing. The operative motion interacts with the lubricating boundary layer in a new and useful way to finish a workpiece surface, preferably a semiconductor wafer surface.

Limited zone boundary lubrication between the workpiece being finished and the finishing element finishing surface is preferred. As used herein, limited zone boundary lubricating is lubricating to reduce friction between two surfaces while simultaneously having wear occur. Limited zone boundary lubricating which simultaneously reduces friction between the operative finishing interface while maintaining a cut rate on the workpiece surface being finished is preferred. Limited zone boundary lubricating which simultaneously reduces friction between the operative finishing interface while maintaining an acceptable cut rate on the workpiece surface being finished is more preferred. Limited zone boundary lubricating which simultaneously reduces friction between the operative finishing interface while maintaining a finishing rate on the workpiece surface being finished is preferred. Limited zone boundary lubricating which simultaneously reduces friction between the operative finishing interface while maintaining an acceptable finishing rate on the workpiece surface being finished is more preferred. Limited zone boundary lubricating which simultaneously reduces friction between the operative finishing interface while maintaining a planarizing rate on the workpiece surface being finished is preferred. Limited zone boundary lubricating which simultaneously reduces friction between the operative finishing interface while maintaining an acceptable planarizing rate on the workpiece surface being finished is more preferred. Limited zone boundary lubricating which simultaneously reduces friction between the operative finishing interface while maintaining a polishing rate on the workpiece surface being finished is preferred. Limited zone boundary lubricating which simultaneously reduces friction between the operative finishing interface while maintaining an acceptable polishing rate on the workpiece surface being finished is preferred. Boundary lubricant types and concentrations are preferably controlled during limited zone lubricating. Limited zone boundary lubricating offers the advantages of controlled wear along with reduced unwanted surface damage.

Boundary lubricants which are polymeric can be very effective boundary lubricants. A boundary lubricant comprising organic synthetic polymer are preferred lubricants. Supplying an organic boundary lubricant to the interface of the workpiece surface being finished and the finishing element finishing surface wherein the boundary lubricant is from 0.1 to 15% by weight of the total fluid between the interface is preferred and from 0.2 to 12% by weight of the total fluid between the interface is more preferred and from 0.3 to 12% by weight of the total fluid between the interface is even more preferred and from 0.3 to 9% by weight of the total fluid between the interface is even more particularly preferred. These preferred ranges are given for general guidance and help to those skilled in the art. Boundary lubricants outside this range are currently believed to be useful but not as economical to use.

A boundary lubricant having functional groups containing elements selected from the group consisting of chlorine, sulfur, nitrogen, and phosphorous is preferred. A boundary lubricant comprising a fatty acid substance is a preferred lubricant. A preferred example of a fatty substance is a fatty acid ester or salt, and potassium salts of fatty acid substances can be effective boundary lubricants. Fatty acid salts of plant origin can be particularly preferred. A lubricant comprising a boundary lubricant synthetic polymer is preferred and a boundary lubricant comprising a boundary lubricant synthetic polymer and wherein the synthetic polymer is water soluble is even more preferred. A polymer having a number average molecular weight from 400 to 150,000 is preferred and one having a number average molecular weight from 1,000 to 100,000 is more preferred and one having a number average molecular weight from 1,000 to 50,000 is even more preferred.

A boundary lubricant which forms a thin lubricant film on the metal conductor portion of a workpiece surface being finished is particularly preferred. A nonlimiting preferred group of example boundary lubricants include at least one lubricant selected from the group consisting of fats, fatty acids, esters, and soaps. A preferred group of boundary lubricants comprise organic boundary lubricants. Another preferred group of boundary lubricants comprise organic synthetic lubricants. A long chain organic molecule having a polar end group is preferred. A phosphorous containing organic compound can be an effective preferred boundary lubricant. A phosphate ester is an example of a preferred phosphorous containing compound which can be an effective boundary lubricant. A chlorine containing organic compound can be an effective preferred boundary lubricant. A sulfur containing organic compound can be an effective preferred boundary lubricant. A nitrogen containing compound can be an effective preferred boundary lubricant. An amine derivative of a polyglycol can be a preferred boundary lubricant. A diglycol amine is a preferred amine derivative of a polyglycol. An organic compound containing at least one element selected from the group consisting of oxygen, fluorine, nitrogen, or chlorine can be a preferred lubricant. A organic compound containing at least two elements selected from the group consisting of oxygen, fluorine, nitrogen, or chlorine can be a more preferred lubricant. A synthetic organic polymer containing atoms selected from the group consisting of at least one of the following elements oxygen, fluorine, nitrogen, or chlorine can be a preferred lubricant. A synthetic organic polymer containing at least two elements from the group consisting of oxygen, fluorine, nitrogen, or chlorine can be a more preferred lubricant. A lubricant free of sodium is a preferred lubricant. As used herein a lubricant free of sodium means that the sodium content is below the threshold value of sodium which will adversely impact the performance of a semiconductor wafer or semiconductor parts made therefrom. A synthetic organic polymer containing atoms selected from the group consisting of at least two of the following elements oxygen, fluorine, nitrogen, or chlorine can be a preferred lubricant A sulfated vegetable oil and sulfurized fatty acid soaps are preferred examples of sulfur containing compound. Boundary lubricant and lubricant chemistries are discussed further herein below. An organic lubricant which reacts physically with at least a portion of the workpiece surface being finished is a preferred lubricant. An organic lubricant which reacts chemically with at least a portion of the workpiece surface being finished is often a more preferred lubricant because it is often a more effective lubricant and can also aid at times directly in the finishing. An organic lubricant which reacts chemically with at least a portion of the workpiece surface being finished and which is nonstaining is a particularly preferred lubricant because it is often a more effective lubricant, is generally easily cleaned from the workpiece, and can also aid directly in the finishing as discussed herein.

Certain particularly important workpieces in the semiconductor industry have regions of high conductivity and regions of low conductivity. The higher conductivity regions are often comprised of metallic materials such as tungsten, copper, aluminum, and the like. An illustrative example of a common lower conductivity region is silicon and silicon oxide. Boundary lubrication which differentially lubricates the two regions is preferred and boundary lubricant which substantially differentially lubricates two regions is more preferred. An example of a differential boundary lubrication is if the effective coefficient of friction is changed by different amounts in one region versus the other region during finishing. An example of differential lubrication is where the boundary lubricant reacts differently with different chemical compositions to create regions having different local regions of tangential friction force and different coefficients of friction. Another example is where the semiconductor surface topography (for instance unwanted raised regions) interacts within the operative finishing interface to create local regions having different tangential friction forces and different coefficients of friction (see for example FIGS. 4 & 8 discussion herein). For instance one region (or area) can have the coefficient of friction reduced by 20% and the other region (or area) reduced by 40%. This differential change in boundary lubrication can be used to help in differential finishing of the two regions. An example of differential finishing is a differential finishing rate between the two regions. For example, a first region can have a finishing rate of "X" angstroms/minute and a second region can have a finishing rate of "Y" angstroms per minute before lubrication and after differential lubrication, the first region can have a finishing rate of 80% of "X" and the second region can have a finishing rate of 60% of "Y" . An example of where this will occur is when the boundary lubricant tends to adhere to one region because of physical or chemical surface interactions (such as a metallic conductive region) and adhere or not adhere as tightly to the an other region (such as a non metallic, non conductive region). Different regions can have different lubricating boundary layer thickness. Changing the finishing control parameters to change the differential boundary lubrication during finishing of the workpiece is a preferred method of finishing. Changing the finishing control parameters to change the differential organic boundary layer lubrication during finishing of the workpiece which in turn changes the region finishing rates in the workpiece is a more preferred method of finishing. Changing the finishing control parameters with in situ process control to change the differential organic boundary layer lubrication during finishing of the workpiece which in turn changes the region finishing rates in the workpiece is an even more preferred method of finishing. A secondary friction sensor probe can aid in an important way in detecting and controlling differential boundary lubrication in the workpieces having heterogeneous surface compositions needing finishing. Selectivity can also be adjusted advantageously as discussed herein below.

Some preferred aqueous emulsion compositions are now discussed in more detail. An oil in water emulsion comprises a preferred aqueous emulsion composition. Generally a oil in water emulsion contains a surfactant or emulsifier to aid the emulsion stability. An aqueous emulsion composition having a surfactant is preferred. An aqueous emulsion having a emulsifier is preferred. A preferred oil is a mineral oil. Paraffinic oils, naphthenic oils, and aromatic organic oils comprise examples of preferred mineral oils. Derivatives of mineral oils are also preferred. Another preferred oil is a vegetable oil. Derivatives of vegetable oils are also preferred. An aqueous emulsion composition comprising a combination of vegetable oil and mineral oil is also preferred. An aqueous emulsion composition comprising a combination of a vegetable oil and a mineral oil can be easier to clean than those having straight mineral oil emulsions. An organic oil having some oxygen functionality can be preferred. General parameters to control during the formation of an emulsion include water temperature, rate of oil addition to the water, and mixing methods. A general temperature range is to adjust the water temperature from about 50 degrees centigrade to about 80 degrees centigrade. Generally a surfactant is dissolved in the phase in which it is the most soluble, the second phase is then added, and the mixture is then vigorously mixed or agitated. The vigorous mixing is generally important to formation of the small droplets. A second mixing with even higher shear forces is also often used. The mixing can be with a propeller style mixer, a colloid mill, or an ultrasound generator. Methods employing phase inversion are also known to those skilled in the emulsion arts. Those skilled in the emulsion arts can readily make oil in water emulsions. A water soluble boundary lubricant in water is a more preferred water borne lubricant. Although water in oil emulsions are known along with the processes of making them, oil in water emulsions or aqueous emulsion compositions are preferred because they are more easily cleaned from the workpiece and are currently considered to be more environmentally friendly. As used herein, an aqueous emulsion composition comprises an organic material emulsified in water. A preferred organic material is a vegetable oil. Another preferred organic material is a mineral oil. Thus the organic material is dispersed in discrete discontinuous regions and the water is the continuous phase. An aqueous emulsion can generally be easily diluted by adding additional water. Further the addition of a water soluble dye will generally readily dye the continuous water phase. Some preferred examples will now be described with more particularity.

Organic materials such as oils for use in an aqueous emulsion composition generally have a preferred viscosity range. Organic materials such as oils have a kinematic viscosity of from 20 to 80 cSt at 40 degrees C. and more preferably from 20 to 80 cSt at 40 degrees C. Preferred oils have a Saybolt viscosity of from 40 to 800 SUS at 100 degrees F. and more preferably from 50 to 600 SUS 100 degrees F. and even more preferably from 60 to 400 SUS at 100 degrees F. Organic materials such as preferred oils have a Saybolt viscosity of at most 800 SUS at 100 degrees F. and more preferably at most 600 SUS at 100 degrees F. and even more preferably at most 400 SUS at 100 degrees F. Organic materials such as oils with these viscosities can be emulsified effectively.

An aqueous emulsion composition which is whitish can be effective and an aqueous emulsion composition in which organic material, more preferably comprising a lubricant, is emulsified forming a pearlescent appearance is more preferred. An aqueous emulsion composition in which organic material, more preferably comprising a lubricant, is emulsified forming a substantially bluish white color is also more preferred. An aqueous emulsion composition in which organic material, more preferably comprising a lubricant, is emulsified forming a greyish, semitransparent appearance is even more preferred and one which is emulsified to a substantially transparent appearance is even more particularly preferred. An aqueous emulsion composition in which organic material, more preferably comprising a lubricant, is emulsified forming a substantially transparent aqueous emulsion composition is even more preferred. An aqueous emulsion composition having a transparency such that a person with 20/20 vision can see his fingers held behind a clear container of aqueous emulsion composition with an inside width of 1.5 cm is preferred and an aqueous emulsion composition having a transparency such that a person with 20/20 vision can see his fingers held behind a clear container of aqueous emulsion composition with an inside width of 3 cm is more preferred and an aqueous emulsion composition having a transparency such that a person with 20/20 vision can see his fingers held behind a clear container of aqueous emulsion composition with an inside width of 5 cm is even more preferred. An aqueous emulsion composition in which organic material, more preferably comprising a lubricant, is emulsified forming a clear appearance are even more particularly preferred. The appearance and transparency of the aqueous emulsion composition is related to the diameter of the organic material droplets dispersed in the water. An aqueous emulsion composition having a pearlescent appearance has organic material droplets which are substantially smaller than a whitish aqueous emulsion composition. A greyish, semitransparent aqueous emulsion composition has smaller organic material droplets than one having a bluish white appearance. A clear aqueous emulsion composition has smaller organic material droplets than one having a greyish, semitransparent appearance. Smaller organic material droplets are currently believed to improve lubrication to the workpiece surface being finished, particularly for semiconductor wafers having a heterogeneous surface composition.

The size of the organic material droplets, preferably oil droplets, can be measured using light scattering techniques and other techniques generally known to those skilled in the art. Small organic matter droplets are preferred. An aqueous emulsion composition having an organic material particle size of at most 2 microns in diameter is preferred and at most 0.3 micron in diameter is more preferred and at most 0.1 micron in diameter is even more preferred. An aqueous emulsion composition having an organic material particle size of from 2 to 0.01 microns in diameter is preferred and from 1 to 0.01 microns in diameter is more preferred and from 0.3 to 0.01 micron in diameter is even more preferred and from 0.1 to 0.01 micron in diameter is even more preferred. Micro-emulsions are preferred because I currently believe they give more uniform lubrication at very small scale feature sizes needed in the manufacture of semiconductor wafers, particularly in semiconductor wafers having a heterogeneous surface composition. Further, micro emulsions are currently believed to, in general, have improved stability. Micro emulsions can often have at least two surfactants. In other words, a micro emulsion can often have a cosurfactant to aid in emulsification. A cosurfactant can lower the interfacial tension to such values so that micro emulsions can often be readily formed. Thus one surfactant can be used to reduce surface tension and another surfactant can be used to stabilize the fine organic droplets formed. Even smaller micro emulsions may be effective in some cases.

Aqueous emulsion compositions having organic material droplets having an average mean diameter size which is related to a semiconductor feature size being finished is preferred for some finishing operations. An aqueous emulsion composition having organic material droplets having an average mean diameter size of at most four (4) times the semiconductor feature size is preferred and an aqueous emulsion composition having organic material droplets having an average mean diameter size of at most twice (2) the semiconductor feature size is more preferred and an aqueous emulsion composition having organic material droplets having an average size of at most one half (½) the semiconductor feature size is even more preferred and an aqueous emulsion composition having organic material droplets having an average size of at most one third (⅓) the semiconductor feature size is even more particularly preferred. An aqueous emulsion composition having organic material droplets having an average mean diameter size of at least one twentieth (1/20) the semiconductor feature size is preferred. It is preferred that the features such as the conductive regions on the semiconductor wafer surface are lubricated. By relating the organic material droplet mean diameter size to the feature size, it is believed that improved lubrication can be effected.

Surfactants and/or emulsifiers are generally used to aid in formation of an aqueous emulsion composition. Generally a surfactant is an organic molecule consisting of a hydrophobic group connected directly or indirectly to a hydrophilic group. The balance between the hydrophilic and hydrophobic groups strongly influences the emulsifying characteristics of the surfactant. A method generally used by those skilled in the art for predicting and guiding the selection of given surfactants for producing the target emulsion is the hydrophilic-lipophilic balance (HLB) method. An HLB number is assigned to assist in selections for various applications and is generally related to the water solubility of the surfactant. An HLB number from 8 to 18 is currently preferred for many aqueous emulsion compositions of this invention. HLB numbers can be used by those skilled in the art for helpful guidance to more rapidly develop the useful aqueous emulsion compositions of this invention. Anionic surfactants are preferred for some aqueous emulsion compositions. Cationic surfactants are also preferred for some aqueous emulsion compositions. Nonionic surfactants are preferred for some aqueous emulsion compositions. Amphoteric surfactants are also preferred for some aqueous emulsion compositions. A surfactant selected from the group consisting of anionic surfactants, cationic surfactants, nonionic surfactants, and amphoteric surfactants is preferred for many aqueous emulsion compositions of this invention. Preferred examples of nonionic surfactants or emulsifiers include nonylphenol ethoxylates, alkanolamides, and PEG esters. ALkanolamides with coemulsifiers selected from the group consisting of sulfonate bases, esters, and soaps are also preferred Thus an aqueous emulsion composition having at least one emulsifier is preferred and an aqueous emulsion composition having at least two emulsifiers is preferred. Emulsifiers aid in the formation and/or an aqueous emulsion composition of this invention. Using two emulsifiers can also aid in the formation and/or stability of the aqueous emulsion compositions of this invention. Alkanolamide emulsifiers are particularly useful in forming aqueous emulsion compositions having micro sized organic material droplets in the aqueous emulsion.

The size of the organic material particles in lubricating dispersions can be measured using light scattering techniques and other techniques generally known to those skilled in the art. Small organic matter particles are preferred. An aqueous dispersion composition having an organic material particle size of at most 2 microns in diameter is preferred and at most 0.3 micron in diameter is more preferred and at most 0.1 micron in diameter is even more preferred. An aqueous dispersion composition having an organic material particle size of from 2 to 0.01 microns in diameter is preferred and from 1 to 0.01 micron in diameter is more preferred and from 0.3 to 0.01 micron in diameter is even more preferred and from 0.1 to 0.01 micron in diameter is even more preferred. Micro-dispersions are preferred because I currently believe they give more uniform lubrication at very small scale feature sizes needed in the manufacture of semiconductor wafers, particularly in semiconductor wafers having a heterogeneous surface composition. Further, micro dispersions are currently believed to, in general, have improved stability. Micro dispersions can often have at least two surfactants.

Some specific chemistries and preferred aqueous lubricating compositions will now be discussed for further guidance.

A boundary lubricant comprising a polyalkylene glycol polymer is a preferred composition. A polymer of polyoxyalkylene glycol monoacrylate or polyoxyalkylene glycol monomethacrylate is very useful as a lubricant. A fatty acid ester can be an effective boundary lubricant. A polyethylene glycol having a molecular weight of 400 to 1000 can be an effective boundary lubricant. Synthetic oligomers can be an effective lubricant. A boundary lubricant comprising a fatty acid ester or salt and cyclodextrin and derivatives of cyclodextrin is a preferred lubricant. A boundary lubricant comprising salts formed from metals, an organic amine or ammonia and aliphatic saturated or unsaturated fatty acid having from 8 to 25 carbon atoms is preferred. An ester formed from at least one acid selected from the group consisting essentially of lauric, myristic, palmitic, stearic, hydroxystearic, arachidic, behenic, erucic, lignoceric, citric and lactic, and at least one alcohol selected from the group consisting essentially of lauryl, myristyl, palmityl, stearyl, arachidyl, behenyl, erucyl, lignoceryl, glycerol, polyglycerol, trimethylolpropane, ethylene glycols, propylene glycols, sorbitols and polysorbitols is preferred and wherein the ester formed has a melting point of above 100 degrees C. is more preferred and wherein the ester formed is soluble in hot water is even more preferred. An ester formed from the groups selected from the group consisting essentially of ethoxylated C12–C18 fatty acids having 2–10 moles of ethylene oxide and ethoxylated C9–C18 fatty alcohols having 2–10 moles of ethylene oxide is preferred and wherein the ester has a melting point of greater than 100 degrees C. is more preferred and wherein the ester is hot water soluble is even more preferred. An ethoxylated long chain ester is a preferred lubricant. A lubricant selected from the group consisting of an ester of pentaerythritol, a fatty acid ester, a trimethylolpropane ester, a dimer diol ester, and mixtures thereof is a preferred lubricant. A glycol etherol is a preferred lubricant. A polyalkylene glycol polymer is a preferred lubricant. A boundary lubricant comprising polyaspartic acid and salts such as potassium thereof are preferred. Polyaspartic acid and salts are generally biodegradable.

A boundary lubricant material selected from the group consisting of an ester of pentacrythritol, a fatty acid ester, a trimethylol-propane ester, a dimer diol ester, and mixtures thereof can be preferred for some applications. Still another group of lubricants include a lubricant comprising using a polycarboxylic acid esters of C4 to C10 monohydric alcohols and polyhydric alcohols. An alcohol of C4 to C10 is preferred and an aliphatic alcohol of from C4 to C10 is more preferred. A boundary lubricant comprising fatty acids containing from C8 to C22 carbon atoms and ester derivatives thereof. Examples of fatty acids include caproic, caprylic, capric, lauric, myristic, palmitic, stearic, palmitoliec, oleic, erucic, and linoleic acids. Examples of polyhydric alcohols include ethylene glycol, diethylene glycol, triethylene glycol, and hexylene glycol. As used herein, the shorthand C4–C10 means a carbon chain from 4 to 10 carbons long and is generally known to those skilled in the art.

Another group of boundary lubricants for use in this invention consists of lubricants selected from the group consisting of vegetable and animal oils, fats, tallows, and waxes or mixtures thereof. Another group of suitable boundary lubricants include lubricants selected from the group consisting of mineral and synthetic lubricants. Non limiting examples of preferred synthetic lubricants include aliphatic and aromatic carboxylates, polymeric esters, and polyalkene oxides. Still another group of preferred lubricants include lubricants selected from the group consisting of poly alpha-olefins, ester based lubricants, phosphates, and polyalkyleneglycols and mixtures thereof with water. Another group of preferred boundary lubricants consists of lubricants selected from the group consisting of lard oil, overbased sulfonates, esters, soaps, and sulfated oils. Water based oils can preferably contain naphthenic or paraffinic oil with viscosities of at most 130 SUS (Saybolt universal seconds) at 100 degrees Fahrenheit.

An aqueous lubricating composition having a polymeric wax is an effective lubricating agent. An aqueous lubricating composition of oxygenated waxes is an effective lubricating agent. An oxygenated hydrocarbon wax is a preferred lubricating agent. An aqueous lubricating of a non-oxygenated parafinic wax is a preferred lubricating agent. An aqueous lubricating of fluorocarbon resin is a preferred lubricating agent. An aqueous lubricating of perfluorocarbon resin is a preferred lubricating agent. Surfactants and general procedures to make aqueous lubricating emulsions are generally known to those skilled in the art.

The aqueous lubricating compositions can also preferably have corrosion inhibitors. Copper corrosion inhibitors are particularly preferred as are aluminum corrosion inhibitors. Nonlimiting preferred examples of copper corrosion inhibitors include benzyl-triazole and tolytriasole. Non limiting illustrative examples of lubricating systems, and/or boundary lubricants are included in U.S. Pat. No. 3,287,288 to Reiling, U.S. Pat. No. 3,458,596 to Eaigle, U.S. Pat. No. 4,180,532 to Chakrabarti et. al., U.S. Pat. No. 4,212,750 to Gorman, U.S. Pat. No. 4,332,689 to Tanizaki, U.S. Pat. No. 4,379,063 to Williams, U.S. Pat. No. 4,383,937 to Williams, U.S. Pat. No. 4,522,733 to Jonnes, U.S. Pat. No. 4,544,377 to Schwen, U.S. Pat. No. 4,636,321 to Kipp et. al., U.S. Pat. No. 4,767,554 to Malito et. al., U.S. Pat. No. 4,877,813 to Jimo et al., U.S. Pat. No. 4,950,415 to Malito, U.S. Pat. No. 5,079,287 to Takeshi et al., U.S. Pat. No. 5,110,685 to Cross et al., U.S. Pat. No. 5,216,079 to Crosby et al., U.S. Pat. No. 5,225,249 to Biresaw, U.S. Pat. No. 5,368,757 to King, U.S. Pat. No. 5,401,428 to Kalota, U.S. Pat. No. 5,433,873 to Camenzind, U.S. Pat. No. 5,496,479 to Videau et. al., U.S. Pat. No. 5,614,482 to Baker et. al., and U.S. Pat. No. 5,591,808 to Jamison and are included for guidance and modification by those skilled in the art and are included by reference in their entirety herein. Further illustrative examples of aqueous lubricating compositions are included in U.S. Pat. No. 4,619,703 to Gerber, U.S. Pat. No. 4,996,259 to Koehler, U.S. Pat. No. 5,326,381 to Wu, U.S. Pat. No. 5,389,136 to Danner, U.S. Pat. No. 5,601,746 to Danner et. al., U.S. Pat. No. 5,743,949 to Kainz, and U.S. Pat. No. 5,750,606 to Miura et. al are included for guidance and modification by those skilled in the art and are included by reference in their entirety herein. Several nonlimniting examples of commercial lubricants, lubricating dispersions, and/or materials which can be used in aqueous lubricating compositions of this invention include products made by DuPont, Daiken America, Inc., Dow Chemical, Huntsman Corporation, and Chevron Corporation. These suppliers, materials, and background art are included herein for general guidance and modification by those skilled in the art according to the guidance and teaching included herein.

Supplying an aqueous lubricating composition for at least a portion of the finishing cycle time is preferred, particularly where polishing of the workpiece surface is important.

Friction sensor subsystems and finishing sensor subsystems having the ability to control the friction probe motions and workpiece motions are preferred and uniquely able to improve finishing in many real time lubrication changes to the operative finishing interface. Boundary lubricants, because of the small amount of required lubricant, are particularly effective lubricants for inclusion in finishing elements.

Generally those skilled in the art know how to measure the kinetic coefficient of friction. A preferred method is ASTM D 3028-95 and ASTM D 3028-95 B is particularly preferred. Those skilled in the art can modify ASTM D 3028-95 B to adjust to appropriate finishing velocities and to properly take into consideration appropriate fluid effects due to the lubricant and aqueous lubricating composition. Preferred boundary lubricants and aqueous lubricating compositions do not corrode the workpiece or localized regions of the workpiece. Corrosion can lead to workpiece failure even before the part is in service. ASTM D 130 is a useful test for screening lubricants for particular workpieces and workpiece compositions. As an example a metal strip such as a copper strip is cleaned and polished so that no discoloration or blemishes are detectable. The aqueous lubricating composition to be tested is then added to a test tube, the copper strip is immersed in the aqueous lubricating composition and the test tube is then closed with a vented stopper. The test tube is then heated under controlled conditions for a set period of time, the metal strip is removed, the aqueous lubricating composition removed, and the metal strip is compared to standards processed under identical conditions to judge the corrosive nature and acceptableness of the aqueous lubricating composition. ASTM D 1748 can also be used to screen for corrosion. These test methods are included herein by reference in their entirety.

Supplying an effective aqueous lubricating composition to the interface between the workpiece surface being finished and the finishing element finishing surface is preferred and supplying an aqueous lubricating composition having an effective amount of boundary lubrication to the operative finishing interface to change finishing rates is more preferred. Boundary lubrication which is less than complete lubrication and facilitates controlling frictional wear and tribochemical reactions is preferred. Independent control of the aqueous lubricating composition control parameters aids in controlling an effective amount of marginal lubrication and in situ control of the lubricant control parameters is more preferred. Control of at least one of the aqueous lubricating composition control parameters independent from changes in abrasives is preferred to enhance control of finishing. Control of at least one of the aqueous lubricating composition control parameters in situ independent from changes in abrasives is preferred to enhance control of finishing. Non limiting examples of preferred independent aqueous lubricating composition control parameters is to feed aqueous lubricating composition separate and independently from any abrasive feed and then to adjust either the feed rate of the aqueous lubricating composition or the concentration(s) in the aqueous lubricating composition.

Recycling an aqueous lubricating composition in which at least a portion of the lubricant is a hydrocarbon lubricant is preferred. Recycling an aqueous lubricating composition having a hydrocarbon lubricant is preferred. Recycling a portion of the lubricant can reduce the operating costs for finishing by reducing the need to buy additional lubricant. Recycling at least some of the hydrocarbon lubricant can reduce some potentially harmful environmental effluents.

Operative Finishing Motion

Chemical mechanical finishing during operation has the finishing element in operative finishing motion to the surface of the workpiece being finished. A relative lateral parallel motion of the finishing element to the surface of the workpiece being finished is an operative finishing motion. Lateral parallel motion can be over very short distances or macro-distances. A parallel circular motion of the finishing element relative to the workpiece surface being finished can be effective. A tangential finishing motion can also be preferred. U.S. Pat. No. 5,177,908 to Tuttle issued in 1993, U.S. Pat. No. 5,234,867 to Schultz et. al. issued in 1993, U.S. Pat. No. 5,522,965 to Chisholm et. al. issued in 1996, U.S. Pat. No. 5,735,731 to Lee in 1998, and U.S. Pat. No. 5,962,947 to Talieh issued in 1997 comprise illustrative nonlimiting examples of operative finishing motion contained herein for further general guidance of those skilled in the arts.

Some illustrative nonlimiting examples of preferred operative finishing motions for use in the invention are also discussed. This invention has some particularly preferred operative finishing motions of the workpiece surface being finished and the finishing element finishing surface. Moving the finishing element finishing surface in an operative finishing motion to the workpiece surface being finished is a preferred example of an operative finishing motion. Moving the workpiece surface being finished in an operative finishing motion to the finishing element finishing surface is a preferred example of an operative finishing motion. Moving the finishing element finishing surface in a parallel circular motion to the workpiece surface being finished is a preferred example of an operative finishing motion. Moving the workpiece surface being finished in a parallel circular motion to the finishing element finishing surface is a preferred example of an operative parallel. Moving the finishing element finishing surface in a parallel linear motion to the workpiece surface being finished is a preferred example of an operative finishing motion. Moving the workpiece surface being finished in a parallel linear motion to the finishing element finishing surface is a preferred example of an operative parallel. The operative finishing motion performs a significant amount of the polishing and planarizing in this invention.

High speed finishing of the workpiece surface with finishing elements can cause surface defects in the workpiece surface being finished at higher than desirable rates because of the higher forces generated. As used herein, high speed finishing involves relative operative motion having an equivalent linear velocity of greater than 300 feet per minute and low speed finishing involves relative operative motion having an equivalent linear velocity of at most 300 feet per minute. The relative operative speed is measured between the finishing element finishing surface and the workpiece surface being finished. Supplying a lubricating aid between the interface of the finishing element finishing surface and the workpiece surface being finished when high speed finishing is preferred to reduce the level of surface defects. Supplying a lubricating aid between the interface of a fixed abrasive cylindrical finishing element and a workpiece surface being finished is a preferred example of high speed finishing. Supplying a lubricating aid between the interface of a fixed abrasive belt finishing element and a workpiece surface being finished is a preferred example of high speed finishing. An operative finishing motion which maintains substantially constant instantaneous relative velocity between the finishing element and all points on the semiconductor wafer is preferred for some finishing equipment. An operative finishing motion which maintains substantially different instantaneous relative velocity between the finishing element and some points on the semiconductor wafer is preferred for some finishing equipment. Nonlimiting illustrative examples of some different finishing elements and a cylindrical finishing element are found in patents U.S. Pat. No. 5,735,731 to Lee, U.S. Pat. No. 5,762,536 to Pant, and U.S. Pat. No. 5,759,918 to Hoshizaki et al. and which can be modified by those skilled in the art as appropriate. U.S. Pat. No. 5,735,731 to Lee, U.S. Pat. No. 5,762,536 to Pant, and U.S. Pat. No. 5,759,918 to Hoshizaki et al. are included herein by reference in their entirety.

Platen

The platen is generally preferably a stiff support structure for the finishing element. The platen surface facing the workpiece surface being finished is parallel to the workpiece surface being planarized and is flat and generally made of metal. A platen which is non stiff can also be used for some finishing applications. The platen reduces flexing of the finishing element by supporting the finishing element; optionally a pressure distributive element can also be used. The platen surface during polishing is in operative finishing motion to the workpiece surface being finished. The platen surface can be static while the workpiece surface being finished is moved in an operative finishing motion. The platen surface can be moved in a parallel motion fashion while the workpiece surface being finished is static. Optionally, both the platen surface and the workpiece being finished can be in motion in a way that creates an operative finishing motion between the workpiece and the finishing element.

Base Support Structure

The base support structure forms structure which can indirectly aid in applying pressure to the workpiece surface being finished. It generally forms a support surface for those members attached to it directly or operatively connected to the base support structure. Other types of base support structure are generally known in the industry and are functional.

Workpiece Finishing Sensor

A workpiece finishing sensor is a sensor which senses the finishing progress to the workpiece in real time so that an in situ signal can be generated. A workpiece finishing sensor is preferred. A workpiece finishing sensor which facilitates measurement and control of finishing in this invention is preferred. A workpiece finishing sensor probe which generates a signal which can be used cooperatively with the secondary friction sensor signal to improve finishing is more preferred.

The change in friction during finishing can be accomplished using technology generally familiar to those skilled in the art. A change in friction can be detected by rotating the workpiece being finished and the finishing element finishing surface with electric motors and measuring current changes on one or both motors. The current changes related to friction changes can then be used to produce a signal to operate the finishing control subsystem. A change in friction can be detected by rotating the workpiece finishing surface with the finishing element finishing surface with electric motors and measuring power changes on one or both motors. Changes in friction can also be measured with thermal sensors. A thermistor is a non-limiting example of preferred non-optical thermal sensor. A thermal couple is another preferred non-optical thermal sensor. An optical thermal sensor is a preferred thermal sensor. An infrared thermal sensor is a preferred thermal sensor. Sensors to measure friction in workpieces being finished are generally known to those skilled in the art. Energy change sensors are a preferred type of sensor for feed back of in situ control information. Non limiting examples of methods to measure friction in friction sensor probes are described in the following U.S. Pat. No. 5,069,002 to Sandhu et. al., U.S. Pat. No. 5,196,353 to Sandhu, U.S. Pat. No. 5,308,438 to Cote et. al., U.S. Pat. No. 5,595,562 to Yau et. al., U.S. Pat. No. 5,597,442 to Chen, U.S. Pat. No. 564,050 to Chen, and U.S. Pat. No. 5,738,562 to Doan et. al. and are included by reference herein in their entirety for guidance and can be advantageously modified by those skilled in the art for use in this invention. Thermal sensors are available commercially from Terra Universal, Inc. in Anaheim, Calif. and Hart Scientific in American Fork, Utah. Measuring the changes in friction at the interface between the workpiece being finished and the finishing element finishing surface to generate an in situ signal for control is particularly preferred because the it can be effectively combined with a secondary friction sensor further improve finishing control.

A workpiece finishing sensor for the workpiece being finished is preferred. A sensor for the workpiece being finished selected from the group consisting of friction sensors, thermal sensors, optical sensors, acoustical sensors, and electrical sensors are preferred sensors for the workpiece being finished in this invention. Workpiece thermal sensors and workpiece friction sensors are non-limiting examples of preferred workpiece friction sensors. As used herein, a workpiece friction sensor can sense the friction between the interface of the workpiece being finished and the finishing element finishing surface during operative finishing motion.

Additional non-limiting preferred examples of workpiece sensors will now be discussed. Preferred optical workpiece sensors are discussed. Preferred non-optical workpiece sensors are also discussed. The endpoint for planarization can be effected by monitoring the ratio of the rate of insulator material removed over a particular pattern feature to the rate of insulator material removal over an area devoid of an underlying pattern. The endpoint can detected by impinging a laser light onto the workpiece being polished and measuring the reflected light versus the expected reflected light as an measure of the planarization process. A system which includes a device for measuring the electrochemical potential of the finishing composition during processing which is electrically connected to the finishing composition, and a device for detecting the endpoint of the process, based on upon the electrochemical potential of the finishing composition, which is responsive to the electrochemical potential measuring device. Endpoint detection can be determined by an apparatus using an interferometer measuring device to direct at an unpatterned die on the exposed surface of the wafer to detect oxide thickness at that point. A semiconductor substrate and a block of optical quartz are simultaneously polished and an interferometer, in conjunction with a data processing system is then used to monitor the thickness and the polishing rate of the optical block to develop an endpoint detection method. A layer over a patterned semiconductor is polished and analyzed using optical methods to determine the end point. An energy supplying means for supplying prescribed energy to the semiconductor wafer is used to develop a detecting means for detecting a polishing end point to the polishing of film by detecting a variation of the energy supplied to the semiconductor wafer. The use of sound waves can be used during chemical mechanical polishing by measuring sound waves emanating from the chemical mechanical polishing action of the substrate against the finishing element. A control subsystem can maintain a wafer count, corresponding to how many wafers are finished and the control subsystem regulates the backside pressure applied to each wafer in accordance with a predetermined function such that the backside pressure increases monotonically as the wafer count increases. The above methods are generally known to those skilled in the art. U.S. Pat. No. 5,081,796 to Schultz, U.S. Pat. No. 5,439,551 to Meikle et al., U.S. Pat. No. 5,461,007 to Kobayashi, U.S. Pat. No. 5,413,941 to Koos et. al., U.S. Pat. No. 5,637,185 Murarka et al., U.S. Pat. No. 5,643,046 Katakabe et al., U.S. Pat. No. 5,643,060 to Sandhu et al., U.S. Pat. No. 5,653,622 to Drill et al., and U.S. Pat. No. 5,705,435 to Chen. are included by reference in their entirety and included herein for general guidance and modification by those skilled in the art.

Changes in lubrication, particularly active lubrication, at the operative finishing interface can significantly affect finishing rates and finishing performance in ways that current workpiece sensors cannot handle as effectively as a remote friction sensor probe (secondary friction sensor probe). For instance, current workpiece sensors can be used in a new, surprising manner to aid in the control of the marginal boundary lubrication as discussed herein. When not operating in the new, surprising manner and continued operation in the older manner renders some prior art workpiece finishing sensors less effective than desirable for controlling during finishing and stopping finishing where friction is adjusted or changed in real time. Secondary friction sensor subsystems as indicated above can help to improve real time control wherein the lubrication is changed during the finishing cycle time. Preferred secondary friction sensors include optical friction sensors and non-optical friction sensors. An optical friction sensor is a preferred friction sensor. Non-limiting preferred examples of optical friction sensors are an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor probe in operative friction contact with the finishing element finishing surface with electric motors and measuring current changes on one or both motors. Secondary friction detectors can be used to sense changes in friction and tangential friction forces. A secondary friction detector comprises a probe that can sense friction at the interface between a material which is separated from the workpiece surface being finished. A preferred secondary friction detector is a friction sensor probe. A friction sensor probe comprises a probe that can sense function at the interface between a material which is separate and unconnected to the workpiece surface being finished and the finishing element finishing surface. Some illustrative secondary friction sensor motions are pulsed direction changes, pulsed pressure changes, and continuous motion such as circular, elliptical, and linear. An operative secondary friction sensor motion is an operative secondary friction sensor motion between the secondary friction sensor surface and the finishing element finishing surface. Details of secondary friction sensors and their use are found in Provisional Patent Application with PTO Serial No. 60/107,300, private serial number NDTLBD1198a filed on the Nov. 6, 1998 and having the title "In Situ Friction Detector for finishing workpieces" and in a Regular Patent Application with private serial number 09/435,181 filed on Nov. 5, 1999 and having the title "In Situ Friction Detector for finishing semiconductor wafers" and they are included in their entirety by reference for general guidance and modification of those skilled in the art. Where the material changes with depth during the finishing of workpiece being finished, one can monitor friction changes with the secondary friction sensor having dissimilar materials even with changing organic boundary layer lubrication and therefore readily detect the end point and also perform in situ adjustments to finishing control parameters to optimize finishing with marginal lubrication.

As a preferred example, the pressure can be changed during finishing. With a friction sensor, a processor can rapidly calculate whether the effective coefficient of friction has changed. If the entire semiconductor wafer surface is covered with organic boundary layer lubrication, the effective coefficient of friction will remain very stable. If the semiconductor wafer surface has some regions free from organic boundary layer lubrication, the effective coefficient of friction will change if the percentage of the surface area covered by the organic boundary layer lubrication changes with the change in pressure. FIG. 5 discussed herein above shows a representative change in the effective coefficient of friction as the area fraction free from organic boundary lubrication changes. In this manner, a pressure change to the secondary friction sensor probe can be used for in situ process control of marginal lubrication In this manner, a pressure change in the operative finishing interface can also be used for in situ process control of marginal lubrication. Changing the applied pressure to a friction sensor is a preferred method of in situ control for marginal lubrication and reducing the applied pressure to a friction sensor is a more preferred method of in situ control. Using a reducing pressure change is normally preferred because this minimizes the abraded particles from the semiconductor wafer surface which helps to reduce unwanted semiconductor wafer surface damage. An example of a reducing pressure change is if the normal pressure during finishing is 6 psi, then a reducing pressure change is to reduce the pressure to 5 or 4 psi.

Process Control Parameters

Preferred process control parameters include those control parameters which can be changed during processing and affect workpiece finishing. Control of the operative finishing motion is a preferred process control parameter. Examples of preferred operative finishing motions include relative velocity, pressure, and type of motion. Examples of preferred types of operative finishing motion include tangential motion, planar finishing motion, linear motion, vibrating motion, oscillating motion, and orbital motion. Finishing temperature is a preferred process control parameter. Finishing temperature can be controlled by changing the heat supplied to the platen or heat supplied to the alternate finishing composition. Alternately, friction can also change the finishing temperature and can be controlled by changes in lubrication, applied pressure during finishing, and relative operative finishing motion velocity. Changes in lubrication can be effected by changing the aqueous lubricating composition(s) and/or feed rate(s). A preferred group of process control parameters consists of parameters selected from the group consisting of operative finishing interface relative velocity, platen velocity, polishing pattern, finishing temperature, force exerted on the operative finishing interface, aqueous lubricating composition, aqueous lubricating composition feed rate, alternate finishing composition, alternate finishing composition feed rate, and finishing pad conditioning Processor A processor is preferred to help evaluate the workpiece finishing sensor information. A processor can be a microprocessor, an ASIC, or some other processing means. The processor preferably has computational and digital capabilities. Non limiting examples of processing information include use of various mathematical equations, calculating specific parameters, memory look-up tables or databases for generating certain parameters such as historical performance, coefficients of friction correlated to particular parameters, or other preferred parameters or constants, neural networks, fuzzy logic techniques for systematically computing or obtaining preferred parameter values. Input parameter(s) can include information on current wafers being polished such as uniformity, expected polish rates, aqueous lubricating compositions, aqueous lubricating composition feed rates, lubricants(s), lubricant concentrations, expected organic boundary layer lubricating characteristics, entering film thickness, temperature, temperature change effects, finishing element, abrasive concentration, abrasive composition, and uniformity, workpiece pattern. Further preferred non-limiting processor capabilities including adding, subtracting, multiplying, dividing, use functions, look-up tables, noise subtraction techniques, comparing signals, and adjusting signals in real time from various inputs and combinations thereof Use of Information for Feedback and Controller Controllers to control the finishing of workpieces are generally known in the art, Controllers generally use information at least partially derived from the processor to make changes to the process control parameters. A processor is preferably operatively connected to a sensor to gain current information about the process and the processor is also operatively connected to a controller which preferably controls the finishing control parameters. As used herein, a control subsystem is a combination of an operative sensor operatively connected to a processor which is operatively connected to a controller which in turn can change finishing control parameters.

An advantage of this invention is the additional degree of control it gives to the operator performing planarization and/or polishing. To better utilize this control, the use of feedback information to control the finishing control parameters is preferred and in situ control is more preferred. Controlling the finishing control parameters selected from the group consisting of aqueous organic boundary lubricant feed rate, aqueous organic boundary lubricant concentration, alternate finishing composition feed rates, alternate finishing composition concentration, operative finishing motion, and operative finishing pressure is preferred to improve control of the finishing of the workpiece surface being finished and in situ control is more particularly preferred. Another preferred example of a finishing control parameter is to use a different finishing element for a different portion of the finishing cycle time such as one finishing element for the planarizing cycle time and a different finishing element for the polishing cycle time. Workpiece film thickness, measuring apparatus, and control methods are preferred methods of control. Mathematical equations including those developed based on process results can be used. Finishing uniformity parameters selected from the group consisting of Total Thickness Variation (TTV), Focal plane deviation (FPD), Within-Wafer Non-Uniformity (WIW NU), and surface quality are preferred. Average cut rate is a preferred finishing rate control parameter. Average finishing rate is a preferred finishing rate control parameter. Controlling finishing for at least a portion of the finishing cycle time with a finishing sensor subsystem to adjust in situ at least one finishing control parameter that affect finishing results is a preferred method of control finishing. Information feedback subsystems are generally known to those skilled in the art. Illustrative non limiting examples of wafer process control methods include U.S. Pat. No. 5,483,129 to Sandhu issued in 1996, U.S. Pat. No. 5,483,568 to Yano issued in 1996, U.S. Pat. No. 5,627,123 to Mogi issued in 1997, U.S. Pat. No. 5,653,622 to Drill issued in 1997, U.S. Pat. No. 5,657,123 to Mogi issued in 1997, U.S. Pat. No. 5,667,629 to Pan issued in 1997, and U.S. Pat. No. 5,695,601 to Kodera issued in 1997 are included herein for guidance and modification by those skilled in the art and are included herein by reference in their entirety.

Controlling at least one of the finishing control parameters using secondary friction sensor information combined with workpiece sensor information is preferred and controlling at least two of the finishing control parameters using secondary friction sensor information combined with workpiece sensor information is more preferred. Using a electronic finishing sensor subsystem to control the finishing control parameters is preferred. Feedback information selected from the group consisting of finishing rate information and product quality information such as surface quality information is preferred. Non-limiting preferred examples of process rate information include polishing rate, planarizing rate, and workpiece finished per unit of time. Non-limiting preferred examples of quality information include first pass first quality yields, focal plane deviation, total thickness variation, measures of non uniformity. Non-limiting examples particularly preferred for electronics parts include Total Thickness Variation (TTV), Focal plane deviation (FPD), Within-Wafer Non-Uniformity (WIW NU), and surface quality.

In situ process control systems relying on workpiece finishing sensors are generally known to those skilled in the CMP industry. Commercial CMP equipment advertised by Applied Materials and IPEC reference some of this equipment.

The use of aqueous lubricating compositions in finishing, particularly those having boundary lubricants, in a preferred embodiment including secondary friction sensor(s), friction sensor controllers, and friction sensor subsystems are unknown in the industry. Supplying a marginal organic boundary layer lubrication with in situ process control to control the fraction of semiconductor wafer surface area free of organic boundary layer lubrication is preferred and unknown in the industry.

Finishing Element Conditioning

A finishing element can be conditioned before use or between the finishing of workpieces. Conditioning a finishing element is generally known in the CMP field and generally comprises changing the finishing element finishing surface in a way to improve the finishing of the workpiece. As an example of conditioning, a finishing element having no basic ability or inadequate ability to absorb or transport an alternate finishing composition can be modified with a finishing element conditioner to have a new texture and/or surface topography to absorb and transport the alternate finishing composition. As a non-limiting preferred example, a finishing element conditioner having a mechanical mechanism to create a finishing element finishing surface which more effectively transports the alternate finishing composition is preferred. The finishing element conditioner having a mechanical mechanism to create a finishing element finishing surface which more effectively absorbs the alternate finishing composition is also preferred. A finishing element conditioner having a mechanical mechanism comprising a plurality of abrasive points which through controlled abrasion can modify the texture or surface topography of a finishing element finishing surface to improve alternate finishing composition absorption and/or transport is preferred. A finishing element conditioner having a mechanical mechanism comprising a plurality of abrasive points comprising a plurality of diamonds which through controlled abrasion can modify the texture and/or surface topography of a finishing element finishing surface to improve alternate finishing composition absorption and/or transport is preferred.

Modifying a virgin finishing element finishing surface with a finishing element conditioner before use is generally preferred. Modifying a finishing element finishing surface with a finishing element conditioner a plurality of times is also preferred. Conditioning a virgin finishing element finishing surface can improve early finishing performance of the finishing element by exposing any lubricants in the finishing element and can expose new fixed abrasive particles which can also change finishing. Modifying a finishing element finishing surface with a finishing element conditioner a plurality of times during its useful life in order to improve the finishing element finishing surface performance over the finishing cycle time by exposing new, unused lubricant such as solid lubricant particles dispersed therein, is preferred. Conditioning a finishing element finishing surface a plurality of times during its useful life can keep the finishing element finishing surface performance higher over its useful lifetime by exposing fresh lubricant particles and or new abrasive particles to improve finishing performance and is also a preferred method. Conditioning a finishing surface by cleaning is preferred. Nondestruction conditioning is a preferred form of conditioning. Using feedback information, preferably information derived from friction sensor probes, to select when to modify the finishing element finishing surface with the finishing element conditioner is preferred. Using feedback information, preferably information derived from a friction sensor probe, to optimize the method of modifying the finishing element finishing surface with the finishing element conditioner is more preferred. Use of feedback information is discussed further herein in other sections. When using a fixed abrasive finishing element, a finishing element having three dimensionally dispersed fixed abrasives is preferred because during the finishing element conditioning process, material is often mechanically removed from the finishing element finishing surface and preferably this removal exposes fresh fixed abrasives in the finishing to alter finishing performance.

Nonlimiting examples of textures and topographies useful for improving transport and absorption of the alternate finishing composition and/or finishing element conditioners and general use are given in U.S. Pat. No. 5,216,843 to Breivogel, U.S. Pat. No. 5,209,760 to Wiand, U.S. Pat. No. 5,489,233 to Cook et. al., U.S. Pat. No. 5,664,987 to Renteln, U.S. Pat. No. 5,655,951 to Meikle et. al., U.S. Pat. No. 5,665,201 to Sahota, and U.S. Pat. No. 5,782,675 to Southwick and are included herein by reference in their entirety for general background and guidance and modification by those skilled in the art.

Cleaning Composition

After finishing the workpiece such as an electronic wafer, the workpiece is generally carefully cleaned before the next manufacturing process step. An aqueous lubricating composition or abrasive particles remaining on the finished workpiece can cause quality problems later on and yield losses.

An aqueous lubricating composition which can be removed from the finished workpiece surface by supplying a water composition to the finished workpiece is preferred and an aqueous lubricating composition which can be removed from the finished workpiece surface by supplying a hot water composition to the finished workpiece is also preferred. An example of a water composition for cleaning is a water solution comprising water soluble surfactants. An aqueous lubricating composition having an effective amount of surfactant which changes the surface tension of water to help clean abrasive and other adventitious material from the workpiece surface after finishing is particularly preferred.

An aqueous lubricating composition which can be removed from the finished workpiece surface by supplying deionized water to the finished workpiece to substantially remove all of the aqueous lubricating composition is preferred and an aqueous lubricating composition which can be removed from the finished workpiece surface by supplying hot deionized water to the finished workpiece to substantially remove all of the aqueous lubricating composition is also preferred. An aqueous lubricating composition which can be removed from the finished workpiece surface by supplying deionized water to the finished workpiece to completely remove the aqueous lubricating composition is more preferred and an aqueous lubricating composition which can be removed from the finished workpiece surface by supplying hot deionized water to the finished workpiece to completely remove the aqueous lubricating composition is also more preferred. Supplying a cleaning composition having a surfactant which removes aqueous lubricating composition from the workpiece surface just polished is a preferred cleaning step. An aqueous lubricating composition which lowers the surface tension of the water and thus helps remove any particles from the finished workpiece surface is preferred.

By using water to remove aqueous lubricating composition, the cleaning steps are lower cost and generally less apt to contaminate other areas of the manufacturing steps. A water cleaning based process is generally compatible with many electronic wafer cleaning process and thus is easier to implement on a commercial scale. Plasma cleaning can also be preferred for some applications and is generally known to those skilled in the semiconductor arts.

Further Comments on Method of Operation

Using an aqueous lubricating composition having at least one boundary lubricant to form a partial lubricating boundary layer between two surfaces when the surfaces are in operative friction contact is preferred. Lubricating boundary layers can be controlled by changing the boundary layer control parameters. A preferred group of aqueous lubricating composition control parameters consists of parameters selected from the group consisting of operative finishing motion, aqueous lubricating composition, aqueous lubricating composition feed rate, and temperature. A preferred group of operative finishing motions consists of motions selected from the group consisting of continuous motion, discontinuous motion, pressure, and velocity of the motion. A preferred group of operative finishing motions consists of motions selected from the group consisting of continuous motion, intermittent motion, and velocity of the motion. Vibrating motion, linear motion, and circular motion are preferred motions for changing or controlling the lubricating boundary layer performance. Changing the pressure at the operative finishing interface can change the organic boundary layer lubricating performance and this is a preferred control parameter as discussed herein above. Changing the motion such as speed or type of motion can change the organic boundary layer lubricating performance. Changing the feed rate of the organic boundary layer lubricant can change the performance. Changing the pressure applied in the operative finishing interface, either total pressure or regional pressure, can change the lubricating boundary layer performance. Changing the temperature in the operative finishing interface, either average or regional temperatures, can change the lubricating boundary layer performance. Changing the chemistry of the aqueous lubricating composition can change the performance. Changing the pressure at the operative finishing interface can change the performance. The above parameters are preferred aqueous lubricating composition control parameters and can be used to effect changes in the finishing of the workpiece surface being finished. Changing an aqueous lubricating composition control parameter to change the effective coefficient of friction at the operative finishing interface is preferred and changing an aqueous lubricating composition control parameter to change the effective coefficient of friction at a region in the operative finishing interface is more preferred and changing a aqueous lubricating composition control parameter to change the effective coefficient of friction in at least two regions of the operative finishing interface is even more preferred. Changing a control parameter to change the tangential force of friction at the operative finishing interface is preferred and changing a control parameter to change the tangential force of friction at a region in the operative finishing interface is more preferred and changing a control parameter to change the tangential force of friction in at least two regions of the operative finishing interface is even more preferred. Changing the organic boundary lubricating layer control parameters at least once during the finishing cycle time is preferred and changing the organic boundary lubricating layer control parameters at least four times during the finishing cycle time is more preferred. Changing the organic boundary lubricating layer control parameters in situ is preferred and changing the organic boundary lubricating layer control parameters in situ with a subsystem controller is more preferred and changing the organic boundary lubricating layer composition control parameters in situ with a controller based on a secondary friction sensor signal is even more preferred. Changing at least one control parameter in situ is preferred and changing at least one control parameter in situ with a subsystem controller is more preferred and changing at least one control parameter in situ with a controller based on a secondary friction sensor signal is even more preferred. Controlling at least one control parameter in situ is preferred and controlling at least one control parameter in situ with a subsystem controller is more preferred and controlling at least one control parameter in situ with a controller based on a secondary friction sensor signal is even more preferred.

Changing at least one organic boundary lubricating layer control parameter during the finishing cycle time in order to change a lubricating boundary layer in a manner that changes the tangential force of friction in at least one region of the semiconductor wafer surface in the operative finishing interface is preferred. Changing at least one of the organic boundary lubricating layer composition control parameters which is in response to an in situ control signal is also preferred. Changing at least one organic boundary lubricating layer control parameter during the finishing cycle time in a manner that changes the effective coefficient of friction in at least two different regions of the semiconductor wafer surface in the operative finishing interface is more preferred. Changing of at least one organic boundary lubricating layer control parameter in a manner that changes the lubricating boundary layers in at least two of different regions of the semiconductor wafer in response to an in situ control signal is also more preferred. Changing the pressure at the operative finishing interface is a particularly preferred organic boundary lubricating layer control parameter. Using a secondary friction sensor signal to aid in changing the aqueous lubricating composition control parameters is even more preferred.

Applying higher pressure in the unwanted raised region on the semiconductor wafer surface compared to pressure applied to the region below the unwanted raised region causing the boundary layer lubrication to be less on the unwanted raised region and the boundary layer lubrication to be greater on at least a portion of the semiconductor wafer surface below the raised region is a preferred method for differential finishing rates. Applying higher pressure in the unwanted raised region on the semiconductor wafer surface compared to pressure applied to the region below the unwanted raised region causing the boundary layer lubrication to be less on the unwanted raised region and a higher temperature on the unwanted raised region and the boundary lubrication to be greater on at least portion of the semiconductor wafer surface below the raised region and a lower temperature on the surface below the raised region is more preferred method for differential finishing rates.

Supplying an aqueous lubricating composition to the workpiece surface being finished which changes the rate of a chemical reaction is preferred. Supplying an aqueous lubricating composition to the workpiece surface being finished having a property selected from the group consisting of a change in workpiece surface effective coefficient of friction, workpiece average finish rate change, a heterogeneous workpiece surface having a different ratio of the effective coefficient of frictions for different regions, and a heterogeneous workpiece surface having different finishing rate changes for different regions which reduces unwanted damage to the workpiece surface is particularly preferred Applying an operative finishing motion in the operative finishing interface forming an organic lubricating layer such that a tangential friction force is created in the operative finishing interface which is dependent on lubricant properties other than lubricant viscosity is preferred. Applying an operative finishing motion in the operative finishing interface forming an organic lubricating layer such that a tangential friction force is created in the operative finishing interface which depends on lubricant properties other than lubricant viscosity is preferred. Applying an operative finishing motion in the operative finishing interface forming a differential organic lubricating layer such that a plurality of different tangential friction forces are created in different regions of the operative finishing interface and wherein the plurality of the different tangential friction forces are dependent on lubricant properties other than lubricant viscosity is more preferred. Applying the greater tangential friction force in the unwanted raised region of the semiconductor wafer surface being finished and also applying the lower tangential friction force to a region below and proximate to the unwanted raised region of the semiconductor wafer surface being finished is also more preferred. By creating this type of lubricating layer, finishing of the semiconductor wafer can be accomplished with good finishing rates and reduced unwanted surface defects. Planarization can be improved. Within die nonuniformity can be improved.

Using the method of this invention to finish a workpiece, especially a semiconductor wafer, by finishing for a period of time at a finishing rate and finishing uniformity according to a controllable set of at least one operational parameter that upon variation changes the polishing rate and/or polishing uniformity and wherein the operational parameters are selected from the group consisting of the aqueous lubricating composition type, aqueous lubricating composition concentration, aqueous lubricating composition activity, pressure at the operative finishing interface, and lubricating time period is preferred. Using the method of this invention to finish a workpiece, especially a semiconductor wafer, by finishing for a period of time wherein an electronic control subsystem connected electrically to the aqueous lubricating composition control mechanism to adjust in situ at least one operational parameter that affects the finishing rate and/or the finishing uniformity and wherein the operational parameters are selected from the group consisting of the aqueous lubricating composition type, aqueous lubricating composition concentration, aqueous lubricating composition activity, and lubricating time period change at the workpiece surface being finished is preferred. The electronic control subsystem is operatively connected electrically to the aqueous lubricating composition control mechanism. A preferred method to measure finishing rate is to measure the change in the amount of material removed in angstroms per unit time in minutes (.ANG./min). Guidance on the measurement and calculation for polishing rate for semiconductor parts is found in U.S. Pat. No. 5,695,601 to Kodera et. al. issued in 1997 and is included herein in its entirety for illustrative guidance.

An average finishing rate range is preferred, particularly for workpieces requiring very high precision finishing such as in process electronic wafers. Average cut rate is used as a preferred metric to describe preferred finishing rates. Average cut rate is metric generally known to those skilled in the art. For electronic workpieces, and particularly for semiconductor wafers, a cut rate of from 100 to 25,000 Angstroms per minute on at least a portion of the workpiece is preferred and a cut rate of from 200 to 15,000 Angstroms per minute on at least a portion of the workpiece is more preferred and a cut rate of from 500 to 10,000 Angstroms per minute on at least a portion of the workpiece is even more preferred and a cut rate of from 500 to 7,000 Angstroms per minute on at least a portion of the workpiece is even more particularly preferred and a cut rate of from 1,000 to 5,000 Angstroms per minute on at least a portion of the workpiece is most preferred. A finishing rate of at least 100 Angstroms per minute for at least one of the regions on the surface of the workpiece being finished is preferred and a finishing rate of at least 200 Angstroms per minute for at least one of the materials on the surface of the workpiece being finished is preferred and a finishing rate of at least 500 Angstroms per minute for at least one of the regions on the surface of the workpiece being finished is more preferred and a finishing rate of at least 1000 Angstroms per minute for at least one of the regions on the surface of the workpiece being finished is even more preferred where significant removal of a surface region is desired. During finishing there are often regions where the operator desires that the finishing stop when a target is reached such as when removing a conductive region (such as a metallic region) over a non conductive region (such as a silicon dioxide region). For regions where it is desirable to stop finishing (such as the silicon dioxide region example above), a finishing rate of at most 1000 Angstroms per minute for at least one of the regions on the surface of the workpiece being finished is preferred and a finishing rate of at most 500 Angstroms per minute for at least one of the materials on the surface of the workpiece being finished is preferred and a finishing rate of at most 200 Angstroms per minute for at least one of the regions on the surface of the workpiece being finished is more preferred and a finishing rate of at most 100 Angstroms per minute for at least one of the regions on the surface of the workpiece being finished is even more preferred where significant removal of a surface region is desired. The finishing rate can be controlled with organic boundary lubricating layers and with the process control parameters discussed herein.

The average cut rate can be measured for different materials on the surface of the semiconductor wafer being finished. For instance, a semiconductor wafer having a region of tungsten can have a cut rate of 6,000 Angstroms per minute and region of silica cut rate of 500 Angstroms per minute. As used herein, selectivity is the ratio of the cut rate of one region divided by another region. As an example, the selectivity of the tungsten region to the silica region is calculated as 6,000 Angstroms per minute divided by 500 Angstroms per minute or selectivity of tungsten cut rate to silica cut rate of 12. Lubricating properties during finishing can change the selectivity. It is currently believed that this is due to differential lubrication in the localized regions. Changing the lubricating properties of the finishing composition to advantageously adjust the selectivity during the processing of a group of semiconductor wafer surfaces or a single semiconductor wafer surface is preferred. Changing lubricating properties of the finishing composition to advantageously adjust the cut rate during the processing of a group of semiconductor wafer surfaces or a single semiconductor wafer surface is preferred. Adjusting the lubricating properties of the finishing composition by changing finishing elements proximate to a heterogeneous surface to be finished is preferred. A finishing element with high initial cut rates can be used initially to improve semiconductor wafer cycle times. Changing to a finishing element with a lubricating finishing composition and a different selectivity ratio proximate to a heterogeneous surface to be finished is preferred. Changing to a finishing element with a lubricating composition and a high selectivity ratio proximate to a heterogeneous surface to be finished is more preferred. In this manner customized adjustments to cut rates and selectivity ratios can be made proximate to critical heterogeneous surface regions. Commercial CMP equipment which can change finishing elements during the finishing cycle time of a semiconductor wafer surface is generally known to those skilled in the art. As discussed above, finishing a semiconductor wafer surface for only a portion of the finishing cycle time with a particular finishing element having dispersed lubricants proximate to a heterogeneous surface is particularly preferred.

Using finishing of this invention to remove raised surface perturbations and/or surface imperfections on the workpiece surface being finished is preferred. Using the method of this invention to finish a workpiece, especially a semiconductor wafer, at a planarizing rate and/or planarizing uniformity according to a controllable set of operational parameters that upon variation change the planarizing rate and/or planarizing uniformity and wherein the operational parameters of at least two operational parameters are selected from the group consisting of the type of aqueous lubricating composition, quantity of aqueous lubricating composition, and time period of lubrication is preferred. Using the method of this invention to finish a workpiece, especially a semiconductor wafer, wherein an electronic control subsystem connected electrically to an operative aqueous lubricating composition feed mechanism adjusts in situ the subset of operational parameters that affect the planarizing rate and/or the planarizing uniformity and wherein the operational parameters are selected from the group consisting of the type of organic boundary layer lubricating composition, quantity of organic boundary layer lubricating composition, and time period for supplying an organic boundary layer lubricating composition is preferred. The electronic control subsystem is, preferably, operatively connected electrically to the operative aqueous lubricating composition feed mechanism.

Using the method of this invention to polish or planarize a workpiece, especially a semiconductor wafer, supplying lubrication moderated by a finishing element having at least two layers is preferred. For planarizing, a finishing element having at least two layers has a finishing surface layer which has a higher hardness than the subsurface layer is preferred. For polishing, a finishing element having at least two layers has a finishing surface layer which has a lower hardness than the subsurface layer is preferred, particularly for polishing.

By having layers in the finishing element, additional control of the polishing and planarizing can be had. Harder layers reduce the tendency of the finishing element to follow the precise contours of the surface defects in a workpiece being finished and, especially planarized. Preferably the finishing element having at least two layers has a polishing surface layer which has a higher tensile strength than the subsurface layer, particularly for planarizing. More preferably the finishing element having at least two layers has a polishing surface layer which has a lower tensile strength than the subsurface layer, particularly when the subsurface layer is fiber reinforced. By optimizing tensile strength of the layers of the finishing element, the amount of material in the finishing element can generally be reduced and longevity increased.

Changing the pressure at the operative finishing interface to detect potential changes in the effective coefficient of friction is preferred and changing the pressure at least four times at the operative finishing interface to detect potential changes in the effective coefficient of friction is more preferred and changing the pressure at least ten times at the operative finishing interface to detect potential changes in the effective coefficient of friction is more preferred and changing the pressure at least twenty times at the operative finishing interface to detect potential changes in the effective coefficient of friction is more preferred Changing the effective coefficient of friction by at least in part changing the pressure applied to the friction sensor is a preferred embodiment. Changing the pressure applied to a secondary friction sensor to detect potential changes in the effective coefficient of friction is preferred and changing the pressure at least four times applied to a secondary friction sensor to detect potential changes in the effective coefficient of friction is more preferred and changing the pressure at least ten times applied to a secondary friction sensor to detect potential changes in the effective coefficient of friction is more preferred and changing the pressure at least twenty times applied to a secondary friction sensor to detect potential changes in the effective coefficient of friction is more preferred. Controlling at least one finishing control parameter changing the effective coefficient of friction in the operative finishing interface is preferred. Changing the aqueous lubricating composition control parameters based on feedback information is preferred and changing the aqueous lubricating composition control parameters in situ based on feedback information with an aqueous lubricating composition control subsystem is more preferred. Changing the aqueous lubricating composition control parameters such as concentration, pressure, and time period (or some combination thereof) can improve the quality of the final finishing step. Supplying a plurality of aqueous lubricating compositions during finishing can be preferred for some applications. Supplying an aqueous lubricating composition having a plurality of lubricants during finishing can be preferred for some applications. Depending on the application and the particular surface at the moment being finished, the plurality of aqueous lubricating compositions can be supplied simultaneously or sequentially. For instance, one can supply a planarizing aqueous lubricating composition and then later a polishing aqueous lubricating composition.

Changing the lubrication control parameters at least once during workpiece finishing is preferred and changing the lubrication control parameters at least twice during workpiece finishing is more preferred. Changing the lubrication control parameters in steps is preferred. Changing the lubrication control parameters based on feedback information is preferred and changing the lubrication control parameters in situ based on feed back information with a lubrication control subsystem is more preferred. Changing the lubrication control parameters such as concentration and time period (or some combination thereof) can improve the quality of the final finishing step. Supplying a plurality of lubricants during finishing can be preferred for some applications. Depending on the application and the particular surface at the moment being finished, the plurality of lubricants can be supplied simultaneously or sequentially. For instance, one can supply a planarizing lubricant and then later a polishing lubricant. A lubrication control parameter is a parameter which affects the lubrication of the operative finishing interface. A boundary lubrication control parameter is a parameter which affects the boundary lubrication in the operative finishing interface. A parameter selected from the group consisting of the lubricant chemistry, lubricant concentration, lubricant feed rate, operative finishing interface temperature, operative finishing interface pressure, and operative finishing interface motion is a preferred lubricating boundary layer control parameter. A parameter selected from the group consisting of the local lubricant chemistry, local lubricant concentration, local lubricant feed rate, local operative finishing interface temperature, local operative finishing interface pressure, and local operative finishing interface motion is a preferred local lubricating boundary layer control parameters.

Supplying an organic lubricant for a portion of finishing cycle time is preferred. Supplying an organic lubricant for a secondary finishing step after a first finishing step free of lubricant, can be preferred. Using two finishing steps, one with lubricant and one free of lubricant can reduce unwanted surface damage when finishing a semiconductor wafer. Using two finishing steps can also increase the finishing rate.

Providing a separate aqueous lubricating composition and a separate alternate finishing composition proximate to the heterogeneous workpiece surface being finished for use between the finishing element surface and the workpiece being finished is a preferred step in the method. Providing an effective amount of an aqueous lubricating composition between the finishing element surface and the workpiece being finished for at least a portion of the finishing time in order to reduce the effective coefficient of friction between the finishing element surface and the workpiece being finished and providing a separate alternate finishing composition between the finishing element finishing surface and the workpiece being finished for at least a portion of the finishing time is also preferred. Separate and distinct feed lines and reservoirs for the aqueous lubricating composition and the alternate finishing composition and delivery of their product by each separate system near or proximate to the point of use are preferred.

SUMMARY

Illustrative nonlimiting examples useful technology have referenced by their patent numbers and all of these patents are included herein by reference in their entirety for further general guidance and modification by those skilled in the arts. The scope of the invention should be determined by the appended claims and their legal equivalents, rather than by the preferred embodiments and details discussed herein.

I claim:

1. A method of finishing of a semiconductor wafer surface being finished during a finishing cycle time comprising the steps of:

providing a finishing element finishing surface;

providing an organic boundary lubricant between the finishing element surface and the semiconductor wafer being finished; and applying an operative finishing motion between the semiconductor wafer surface being finished and the finishing element wherein from 0.001 to 0.25 surface area fraction of the semiconductor wafer surface being finished is free of organic boundary layer lubrication for at least a portion of the finishing cycle time.

2. A method of finishing of the semiconductor wafer surface being finished according to claim 1 wherein:

the semiconductor wafer surface is at least 300 mm in diameter;

the semiconductor wafer surface has a conductive region comprising copper; and the finishing element comprises an organic synthetic polymer having flexural modulus of at least 20,000 psi when measured according to ASTM 790 B at 73 degrees Fahrenheit.

3. A method of finishing of the semiconductor wafer surface being finished according to claim 1 wherein the finishing element is comprised of an organic synthetic polymer having flexural modulus of at least 20,000 psi when measured according to ASTM 790 B at 73 degrees Fahrenheit.

4. A method of finishing of the semiconductor wafer surface being finished according to claim 1 wherein the organic boundary lubricating layer is capable of changing from a solid organic boundary lubricating layer to a liquid organic boundary lubricating layer in the temperature range from 20 to 100 degrees centigrade.

5. A method of finishing of a heterogeneous semiconductor wafer surface having a surface being finished wherein the semiconductor wafer surface has different uniform regions comprising the steps of:

a) providing a finishing element finishing surface;

b) providing an organic boundary lubricant between the finishing element finishing surface and the semiconductor wafer surface being finished;

c) applying an operative finishing motion between the semiconductor wafer surface being finished and the finishing element finishing surface forming an organic lubricating boundary layer on the semiconductor wafer surface wherein:

the operative finishing motion forms a friction in the interface between a uniform region on the semiconductor wafer surface and the finishing element finishing surface;

the organic lubricating boundary layer physically or chemically interacts with and adheres to a uniform region of the semiconductor wafer surface; and the friction formed between the uniform region of the semiconductor wafer surface and the finishing element finishing surface is determined by lubricant properties other than viscosity; and from 0.01 to 0.25 surface area fraction of the uniform region of the heterogeneous semiconductor wafer surface is free of organic boundary layer lubrication; and d) finishing at least a portion of the uniform region of the semiconductor wafer surface with a cut rate of from 100 to 25,000 Angstroms per minute.

6. A method of finishing of the semiconductor wafer surface being finished according to claim 5 wherein from 0.01 to 0.20 surface area fraction of at least one uniform region of thee heterogeneous semiconductor wafer surface is effectively free of organic boundary layer lubrication.

7. A method of finishing of the semiconductor wafer surface being finished according to claim 5 wherein the uniform region comprises a polymeric region.

8. A method of finishing of the semiconductor wafer surface being finished according to claim 5 wherein the organic boundary lubricating layer is capable of changing from a solid organic boundary lubricating layer to a liquid organic boundary lubricating layer in the temperature range from 20 to 100 degrees centigrade.

9. A method of finishing of a semiconductor wafer surface being finished according to claim 5 wherein the finishing element is comprised of an organic synthetic polymer having flexural modulus of at least 20,000 psi when measured according to ASTM 790 B at 73 degrees Fahrenheit.

10. A method of finishing of the semiconductor wafer surface being finished according to claim 5 wherein a plurality of unwanted raised regions in the uniform regions on the heterogeneous semiconductor wafer surface have a higher effective coefficient of friction and a higher temperature than the surface area proximate to the unwanted raised regions.

11. A heterogeneous semiconductor wafer having a surface finished by the process of claim 5.

12. A method of finishing of a semiconductor wafer surface having a uniform region being finished during a finishing cycle time comprising the steps of:

a) providing a finishing element finishing surface;

b) providing an organic boundary lubricant between the finishing element finishing surface and the semiconductor wafer surface being finished;

c) applying an operative finishing motion at the operative finishing interface forming an organic lubricating boundary layer on the semiconductor wafer surface wherein:

the operative finishing motion forms a friction in the interface between a uniform region on the semiconductor wafer surface and the finishing element finishing surface;

the organic lubricating boundary layer physically or chemically interacts with and adheres to the uniform region on the semiconductor wafer surface; and the friction formed between the uniform region on the semiconductor wafer surface and the finishing element finishing surface is determined by lubricant properties other than viscosity; and from 0.001 to 0.25 surface area fraction of the uniform region on the semiconductor wafer surface is free of organic boundary layer lubrication for at least a portion of the finishing cycle time;

(d) using a friction sensor operatively connected to a processor to determine changes in the effective coefficient of friction during the finishing cycle time; and (e) controlling at least one finishing control parameter with control subsystem in situ in order to change the finishing of the semiconductor wafer surface.

13. A method of finishing of the semiconductor wafer surface being finished according to claim 12 in step e) wherein controlling comprises changing at least one organic boundary lubricating layer control parameter during the finishing cycle time in order to change an organic lubricating boundary layer in a manner that changes the tangential force of friction in at least one uniform region of the semiconductor wafer surface in the operative finishing interface.

14. A method of finishing of the semiconductor wafer surface being finished according to claim 12 in step c) wherein controlling comprises changing the regional temperature in the operative finishing interface to change the organic lubricating boundary layer performance.

15. A method of finishing of the semiconductor wafer surface being finished according to claim 12 in step c) wherein controlling comprises changing the average temperature in the operative finishing interface to change the organic lubricating boundary layer performance.

16. A method of finishing of a semiconductor wafer surface having a conductive region being finished during a finishing cycle time comprising the steps of:

providing a finishing element finishing surface;

providing an organic boundary lubricant between the finishing element finishing surface and the semiconductor wafer surface being finished; and applying an operative finishing motion between the semiconductor wafer surface being finished and the finishing element finishing surface forming an organic lubricating boundary layer on the conductive region on the semiconductor wafer surface wherein:

the operative finishing motion forms a friction in the interface between the conductive region on the semiconductor wafer surface and the finishing element finishing surfaces the organic lubricating boundary layer physically or chemically interacts with and adheres to the conductive region on the semiconductor wafer surface;

the friction formed between the conductive region on the semiconductor wafer surface and the finishing element finishing surface is determined by lubricant properties other than viscosity; and from 0.001 to 0.25 surface area fraction of the conductive region on the semiconductor wafer surface being finished is free of the organic lubricating boundary layer for at least a portion of the finishing cycle time.

17. A method of finishing of the semiconductor wafer surface having a conductive region being finished according to claim 16 wherein the conductive region comprises copper.

18. A method of finishing of the semiconductor wafer surface having a conductive region being finished according to claim 16 wherein the organic lubricating boundary layer comprises a solid organic lubricating boundary layer.

19. A method of finishing of the semiconductor wafer surface having a conductive region being finished according to claim 16 wherein the organic lubricating boundary layer comprises a liquid organic lubricating boundary layer.

20. A method of finishing of the semiconductor wafer surface having a conductive region being finished according to claim 16 wherein the finishing element finishing surface has abrasive asperities.

21. A method of finishing of the semiconductor wafer surface having a conductive region being finished according to claim 16 wherein the finishing element finishing surface comprises a finishing surface free of fixed abrasives and further comprising a finishing composition which is free of abrasive particles.

22. A method of finishing of a semiconductor wafer surface having a nonconductive region being finished during a finishing cycle time comprising the steps of:

providing a finishing element finishing surface;

providing an organic boundary lubricant between the finishing element finishing surface and the semiconductor wafer surface being finished; and applying an operative finishing motion between the semiconductor wafer surface being finished and the finishing element finishing surface forming an organic lubricating boundary layer on the nonconductive region on the semiconductor wafer surface wherein:

the operative finishing motion forms a friction in the interface between the nonconductive region on the semiconductor wafer surface and the finishing element finishing surface;

the organic lubricating boundary layer physically or chemically interacts with and adheres to the nonconductive region on the semiconductor wafer surface;

the friction formed between the nonconductive region on the semiconductor wafer surface and the finishing element finishing surface is determined by lubricant properties other than viscosity; and from 0.001 to 0.25 surface area fraction of the nonconductive region on the semiconductor wafer surface being finished is free of organic boundary layer lubrication for at least a portion of the finishing cycle time.

23. A method of finishing of the semiconductor wafer surface having a nonconductive region being finished according to claim 22 wherein the nonconductive region comprises a polymeric region.

24. A method of finishing of the semiconductor wafer surface having a nonconductive region being finished according to claim 22 wherein the organic lubricating boundary layer comprises a solid organic lubricating boundary layer.

25. A method of finishing of the semiconductor wafer surface having a nonconductive region being finished according to claim 22 wherein the organic lubricating boundary layer comprises a liquid organic lubricating boundary layer.

26. A method of finishing of the semiconductor wafer surface having a nonconductive region being finished according to claim 22 wherein the finishing element finishing surface has abrasive asperities.

27. A method of finishing of the semiconductor wafer surface having a nonconductive region being finished according to claim 22 wherein the finishing element finishing surface comprises a finishing surface free of fixed abrasives and further comprising a finishing composition which is free of abrasive particles.

28. A method of finishing of a semiconductor wafer surface having a uniform conductive region and a uniform nonconductive region being finished during a finishing cycle time comprising the steps of providing a finishing element finishing surface;

providing an organic boundary lubricant between the finishing element surface and the semiconductor wafer surface being finished; and applying an operative finishing motion between the semiconductor wafer surface being finished and the finishing element finishing surface forming an organic lubricating boundary layer on the uniform conductive region and on the uniform nonconductive region on the semiconductor wafer surface wherein:

the operative finishing motion forms a first friction in the interface between the uniform conductive region on the semiconductor wafer surface and the finishing element finishing surface and forms a second friction form in the interface between the uniform nonconductive region on the semiconductor wafer surface and the finishing element finishing surface;

the organic lubricating boundary layer physically or chemically interacts with and adheres to the uniform conductive region and the uniform nonconductive region on the semiconductor wafer surface; and the first friction formed between the uniform conductive region on the semiconductor wafer surface and the finishing element finishing surface and the second friction formed between the uniform nonconductive region on the semiconductor wafer surface and the finishing element finishing surface are both determined by lubricant properties other than viscosity; and from 0.001 to 0.25 surface area fraction of the uniform conductive region and the uniform nonconductive region on the semiconductor wafer surface being finished is free of organic boundary layer lubrication for at least a portion of the finishing cycle time.

* * * * *